US011501720B2

(12) United States Patent
Liu et al.

(10) Patent No.: US 11,501,720 B2
(45) Date of Patent: Nov. 15, 2022

(54) DISPLAY PANEL, DRIVING METHOD AND DISPLAY DEVICE

(71) Applicant: SeeYA Optronics Co., Ltd., Shanghai (CN)

(72) Inventors: Ping-Lin Liu, Shanghai (CN); Tong Wu, Shanghai (CN)

(73) Assignee: SeeYA Optronics Co., Ltd., Shanghai (CN)

( * ) Notice: Subject to any disclaimer, the term of this patent is extended or adjusted under 35 U.S.C. 154(b) by 0 days.

(21) Appl. No.: 17/389,584

(22) Filed: Jul. 30, 2021

(65) Prior Publication Data

US 2022/0208120 A1 Jun. 30, 2022

(30) Foreign Application Priority Data

Dec. 30, 2020 (CN) ..... 202011608249.2

(51) Int. Cl.
*G09G 3/3283* (2016.01)
*G09G 3/3258* (2016.01)

(52) U.S. Cl.
CPC ..... *G09G 3/3283* (2013.01); *G09G 3/3258* (2013.01); *G09G 2300/0852* (2013.01); *G09G 2310/0272* (2013.01); *G09G 2310/061* (2013.01); *G09G 2320/0233* (2013.01)

(58) Field of Classification Search
CPC ..... H01L 27/32–3279; G09G 3/32–3291
See application file for complete search history.

(56) References Cited

U.S. PATENT DOCUMENTS

2006/0232522 A1* 10/2006 Roy ..... G09G 3/3291 345/76
2011/0205206 A1* 8/2011 Yoo ..... G09G 3/3275 345/82
2017/0278457 A1* 9/2017 Zhu ..... G09G 3/3233
2018/0348917 A1* 12/2018 Wang ..... G06F 3/046
2021/0125568 A1* 4/2021 Yuan ..... G09G 3/3266

* cited by examiner

*Primary Examiner* — Sanjiv D. Patel
(74) *Attorney, Agent, or Firm* — Kolitch Romano Dascenzo Gates LLC

(57) ABSTRACT

A display panel comprises a reset module, a data-writing module, a driving transistor, a light-emitting control module, a first memory module and a first signal module. The reset module is configured to provide a reset signal to an anode of a light-emitting element through a light-emitting control module. The first signal module is configured to provide a data voltage signal to the data-writing module in a data-writing stage to write the data voltage signal to a gate electrode of the driving transistor and a first end of the first memory module through the data-writing module and provide a data current signal to the driving transistor in the data-writing stage to compensate a threshold voltage of the driving transistor to the second node. The light-emitting control module controls a driving current generated by the driving transistor to flow into a light-emitting element to drive the light-emitting element to emit light.

20 Claims, 19 Drawing Sheets

DISPLAY PANEL, DRIVING METHOD AND DISPLAY DEVICE

CROSS-REFERENCE TO RELATED APPLICATIONS

This application claims priority to Chinese Patent Application No. 202011608249.2, filed on Dec. 30, 2020, the entire contents of which are incorporated herein by reference.

TECHNICAL FIELD

The present disclosure relates to display technology, and more particularly to a display panel, a driving method and a display device.

BACKGROUND

OLED (Organic Light Emitting Diode) display devices have the advantages of being self-luminous, having a low driving voltage and a short response time, and being flexible etc. The OLED display devices have a great potential of development.

OLED display devices normally have corresponding pixel circuits to drive the OLED elements to emit light. However, the pixel circuits in the prior art do not have threshold compensation function. Therefore, the uniformity in display of such display devices is not desirable.

SUMMARY

In a first aspect of the present disclosure, a display panel is provided. The display panel comprises a substrate; a plurality of sub-pixels located on one side of the substrate; and at least one first signal module. Each sub-pixel includes a pixel circuit and a light-emitting element, and the pixel circuit includes a reset module, a data-writing module, a driving transistor, a light-emitting control module and a first memory module. The data-writing module, a first end of the first memory module and a gate electrode of the driving transistor are electrically connected to a first node; the reset module, a first electrode of the driving transistor, the light-emitting control module and a second end of the first memory module are electrically connected to a second node; and the light-emitting element is electrically connected to the light-emitting control module. A first output end of the first signal module is electrically connected to the data-writing module, and a second output end of the first signal module is electrically connected to the reset module The reset module is configured to provide a reset signal to an anode of the light-emitting element through the light-emitting control module in a reset stage The first signal module is configured to provide a data voltage signal to the data-writing module in a data-writing stage to write the data voltage signal to the gate electrode of the driving transistor and the first end of the first memory module through the data-writing module; and is further configured to provide a data current signal to the driving transistor in the data-writing stage to compensate the threshold voltage of the driving transistor to the second node; the light-emitting control module is configured to control a driving current generated by the driving transistor to flow into the light-emitting element to drive the light-emitting element to emit light.

In a second aspect of the present disclosure, a control method of a display panel is provided, the method comprises:

in a reset stage, providing a reset signal, by the reset module, to the anode of the light-emitting element through the light-emitting control module;

in a data-writing stage, providing, by the first signal module, a data voltage signal to the data-writing module to write the data voltage signal to the gate electrode of the driving transistor and the first end of the first memory module through the data-writing module, and providing, by the first signal module, a data current signal to the driving transistor to compensate the threshold voltage of the driving transistor to the second node; and in a light-emitting stage, controlling, by the light-emitting control module, the driving current generated by the driving transistor to flow into the light-emitting element to drive the light-emitting element to emit light.

In a third aspect of the present disclosure, a display device is provided. The display device comprises a display panel according to the above first aspect of the present disclosure.

It should be readily understood that both the foregoing general description and the following detailed description are exemplary and explanatory only, and are not intended as a limitation to the scope of the present disclosure.

BRIEF DESCRIPTION OF THE DRAWINGS

The foregoing and other features, and advantages of the invention are apparent from the following detailed description taken in conjunction with the accompanying drawings in which.

DETAILED DESCRIPTION

In the following, embodiments of the present disclosure will be described in detail with reference to the figures. It should be understood that, the embodiments described hereinafter are only used for explaining the present disclosure, and should not be understood to limit the present disclosure. To describe the embodiments more clearly, the figures only show some aspects, instead of every aspect, of the present disclosure.

Figure 1:
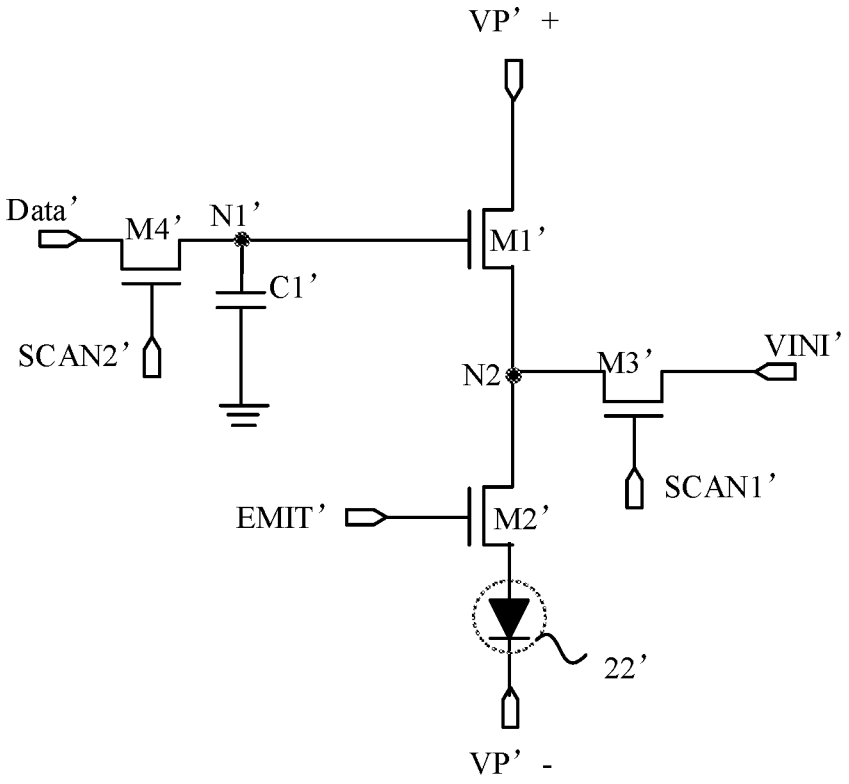
FIG. 1 is a circuit diagram of a traditional pixel circuit.

FIG. 1 is a circuit diagram of a pixel circuit. As shown in FIG. 1, the pixel circuit includes a driving transistor M1', a light-emitting control transistor M2', an initialization transistor M3' and a data-writing transistor M4'. In a reset stage, a first scan signal input from a first scan signal end SCAN1' turns on the initialization transistor M3', and a light-emitting control signal Emit' input from a light-emitting control signal end EMIT' turns on the light-emitting control transistor M2', so that a initialization signal Vini' transmitted by a initialization signal end VINI' is written to an anode of a light-emitting element 22', through the turned-on initialization transistor M3' and the turned-on light-emitting control transistor M2', to initialize the anode of the light-emitting element 22'. In a data-writing stage, a second scan signal input from a second scan signal end SCAN2' turns on the data-writing transistor M4', so that a data signal Vdata' transmitted by a data signal end Data' is written to a gate electrode of the driving transistor M1', through the turned-on data-writing transistor M4'. Then an electric potential of the gate electrode N1' of the driving transistor M1' is self-adapted to a certain electric potential. For example, when the driving transistor M1' is a NMOS transistor, the electric potential of the gate electrode N1' of the driving transistor M1' is Vdata'-Vth', Vth' is a threshold voltage of the driving transistor M1'. In a light-emitting stage, the light-emitting control signal Emit' turns on the light-emitting control transistor M2', the pixel circuit provides a driving voltage Vdata'-Vth' to the anode of the light-emitting element 22', the light-emitting element 22' emits light. The pixel circuit has no threshold compensation function, so the uniformity of the display panel is not good enough. In addition, the attenuation of the light emitted by the light-emitting element 22' has a great influence on the pixel circuit, that is, as the gate voltage of the driving transistor M1' is a stable value, when the efficiency of the light-emitting element 22' has a slight variation, the gate-source voltage $V_{GS}'$ and the drain-source voltage $V_{DS}'$ of the driving transistor M1' both vary, so the display brightness will have a greater variation.

To solve the above issues, the present disclosure provides a display panel. As illustrated in an exemplary embodiment in FIG. 2 the display panel comprises a substrate and a plurality of sub-pixels located on one side of the substrate. Each sub-pixel includes a pixel circuit and a light-emitting element. The pixel circuit includes a reset module, a data-writing module, a driving transistor, a light-emitting control module and a first memory module. The data-writing module, a first end of the first memory module and a gate electrode of the driving transistor are electrically connected to a first node. The reset module, a first electrode of the driving transistor, the light-emitting control module and a second end of the first memory module are electrically connected to a second node. The light-emitting element is electrically connected to the light-emitting control module. The display panel further includes at least one first signal module for providing a data current signal and a data voltage signal. A first output end of the first signal module is electrically connected to the data-writing module, and a second output end of the first signal module is electrically connected to the reset module. The reset module is configured to provide a reset signal to an anode of the light-emitting element through the light-emitting control module in a reset stage. The first signal module is configured to provide a data voltage signal to the data-writing module in a data-writing stage to write the data voltage signal to the gate electrode of the driving transistor and the first end of the first memory module, through the data-writing module. The first signal module is further configured to provide a data current signal to the driving transistor in the data-writing stage to compensate the threshold voltage of the driving transistor to the second node. The light-emitting control module is configured to receive the driving current from the driving transistor, and passing the driving current the light-emitting element, to drive the light-emitting element to emit light.

In the embodiment of the present disclosure, the first signal module is capable of providing a data voltage signal to the data-writing module in a data-writing stage to write the data voltage signal to the gate electrode of the driving transistor and the first end of the first memory module through the data-writing module. The first signal module is further capable of providing a data current signal to the driving transistor in the data-writing stage to compensate the threshold voltage of the driving transistor to the second node to realize the threshold compensation function. Furthermore, when the first memory module is a capacitor, even if the light emitted by the light-emitting element attenuates and the voltage of the second node floats, the voltage of the first node will change correspondingly due to the coupling effect of the capacitor to inhibit the attenuation impact of the light-emitting element. Therefore, the uniformity of the display panel will be improved. In addition, the pixel circuit according to the embodiment of the present disclosure has a simple structure and a small size, which increases the resolution of the display panel.

The above describes the core concept of the present disclosure, and those skilled in the art can get other embodiments, based on the embodiments of the present disclosure, without making any creative work, which are all within the protection scope of the present disclosure. In the following, the embodiments of the present disclosure will be further described clearly and fully combining with the figures according to the embodiments of the present disclosure.

Figure 2:
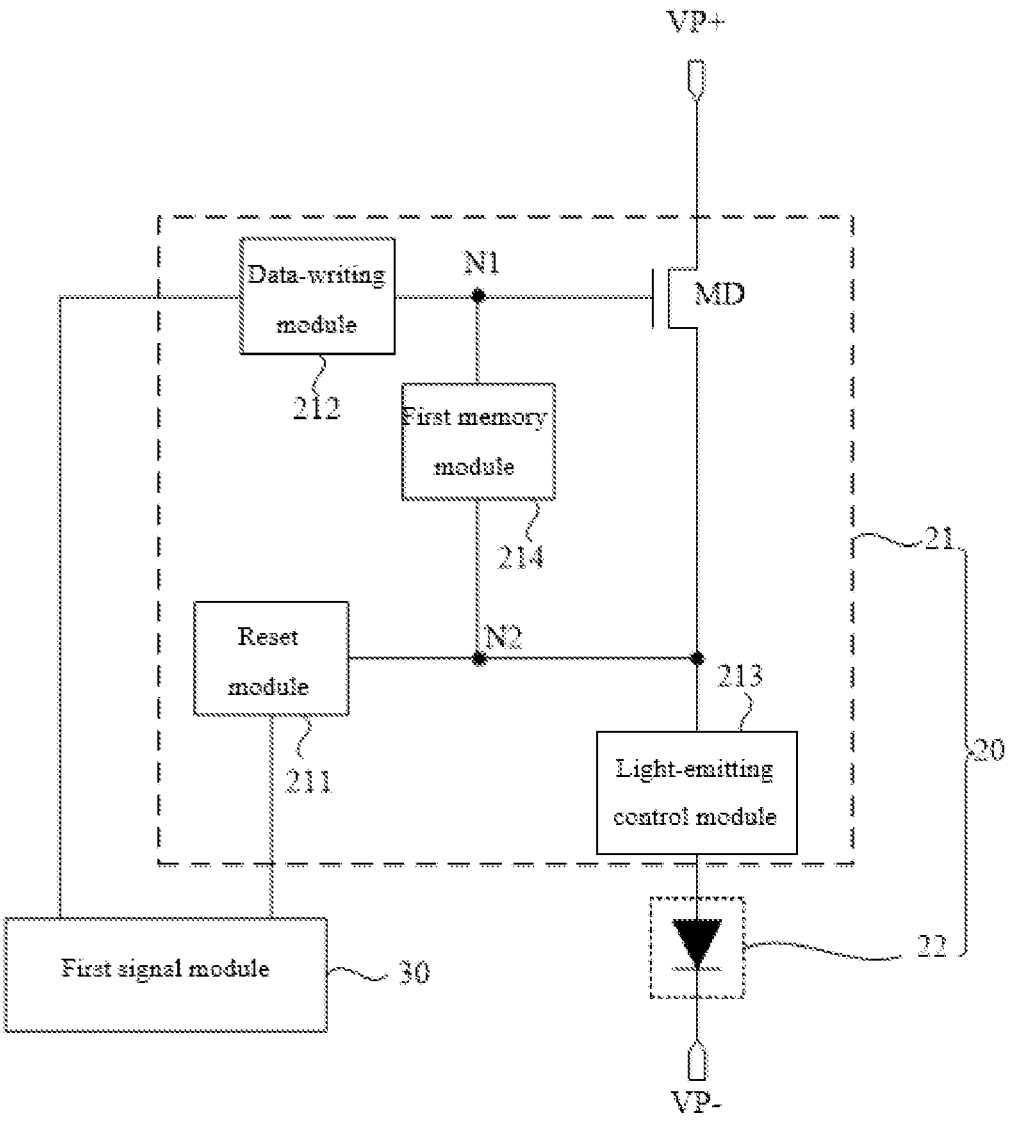
FIG. 2 is a structural schematic diagram of a part of a display panel according to an embodiment of the present disclosure.

FIG. 2 is a structural schematic diagram of a part of the display panel according to an embodiment of the present disclosure. The display panel includes a substrate (not shown) and a plurality of sub-pixels 20 located on one side of the substrate. Each sub-pixel 20 includes a pixel circuit 21 and a light-emitting element 22. The pixel circuit 21 includes a reset module 211, a data-writing module 212, a driving transistor MD, a light-emitting control module 213 and a first memory module 214. The data-writing module 212, a first end of the first memory module 214 and a gate electrode of the driving transistor MD are electrically connected to a first node N1. The reset module 211, a first electrode of the driving transistor MD, the light-emitting control module 213 and a second end of the first memory module 214 are electrically connected to a second node N2. The light-emitting element 22 is electrically connected to the light-emitting control module 213. The display panel further includes at least one first signal module 30 for providing a data current signal and a data voltage signal. A first output end of the first signal module 30 is electrically connected to the data-writing module 212, and a second output end of the first signal module 30 is electrically connected to the reset module 211. The reset module 211 is configured to provide a reset signal to an anode of the light-emitting element 22, through the light-emitting control module 213 in a reset stage. The first signal module 30 is configured to provide a data voltage signal to the data-writing module 212 in a data-writing stage, to write the data voltage signal to the gate electrode of the driving transistor MD and the first end of the first memory module 214, through the data-writing module 212. The first signal module 30 is further configured to provide a data current signal to the driving transistor MD in the data-writing stage, to compensate the threshold voltage Va, of the driving transistor MD to the second node N2. The light-emitting control module 213 is configured to receive the driving current from the driving transistor MD, and passing the driving current to the light-emitting element 22 to drive the light-emitting element 22 to emit light.

Specifically, in the reset stage, the reset voltage is written to the anode of the light-emitting element 22 to initialize the electric potential of the anode of the light-emitting element 22, and decrease the effect from the voltage on the anode of the light-emitting element 22 in the last frame to the voltage on the anode of the light-emitting element 22 in the current frame, such that the uniformity in display is improved. Optionally, the first signal module 30 is capable of outputting a reset voltage and writing the reset voltage to the anode of the light-emitting element 22 through the reset module 211 and the light-emitting control module 213. The reset voltage can be output by the first signal module 30, thus there is no need to provide a separate module to provide the reset voltage and the structure of the pixel circuit is simplified In the data-writing stage, the first signal module 30 outputs the data voltage signal Vdata, which is required for display, then the data voltage signal Vdata is written to the gate electrode of the driving transistor MD and the first end of the first memory module 214, that is, the first node N1. At this time, the data-writing module 212, the driving transistor MD, the reset module 211 and the first signal module 30 together form a loop. The first signal module 30 not only provides the data voltage signal Vdata required for display, but also provide a data current signal ID required for display after compensation. At this time, the current in the loop is the data current signal ID, that is, the current $I_{MD}$ of the driving transistor MD is equal to the data current signal ID. When the current $I_{MD}$ of the driving transistor MD is a stable value, the source electrode of the driving transistor MD will be self-adapted to a certain voltage, that is, the second node N2 is self-adapted to a certain voltage, so that $ID=I_{MD}=k*(Vgs-Vth)=k*(Vdata-V_{N2}-Vth)^2$, $$k = \frac{1}{2}\mu C_{ox}\frac{W}{L},$$

wherein, μ is the carrier mobility, $C_{ox}$ is the channel capacitance in a unit area of the driving transistor MD, $$\frac{W}{L}$$

is a ratio of width to length of the driving transistor MD. Therefore, the voltage of the second node N2 includes the information of the threshold voltage Vth of the driving transistor MD. The voltage of the first node N1 and the voltage of the second node N2 are both stored in the first memory module 214, that is, the voltage range of the first memory module 214 is $Vdata-V_{N2}$.

In the light-emitting stage, the light-emitting control module 213 is turned on, the light-emitting current $I_{MD}$ at this time is: $I_{MD}=k*(Vdata-V_{N2}-Vth)^2$. As the voltage of the second node N2 includes the information of the threshold voltage Vth of the driving transistor MD, the threshold voltage compensation of the driving transistor MD is realized, the light-emitting element 22 is no longer impacted by the threshold voltage Vth, the unity in display is improved. Furthermore, if the first memory module 214 is a capacitor, even if the light emitted by the light-emitting element 22 attenuates and the voltage of the second node N2 varies, the voltage of the first node N1 will also vary under the coupling effect of the capacitor, to inhibit the attenuation influence of the light emitted by the light-emitting element 22, therefore, the uniformity of the display panel will be improved.

Figure 3:
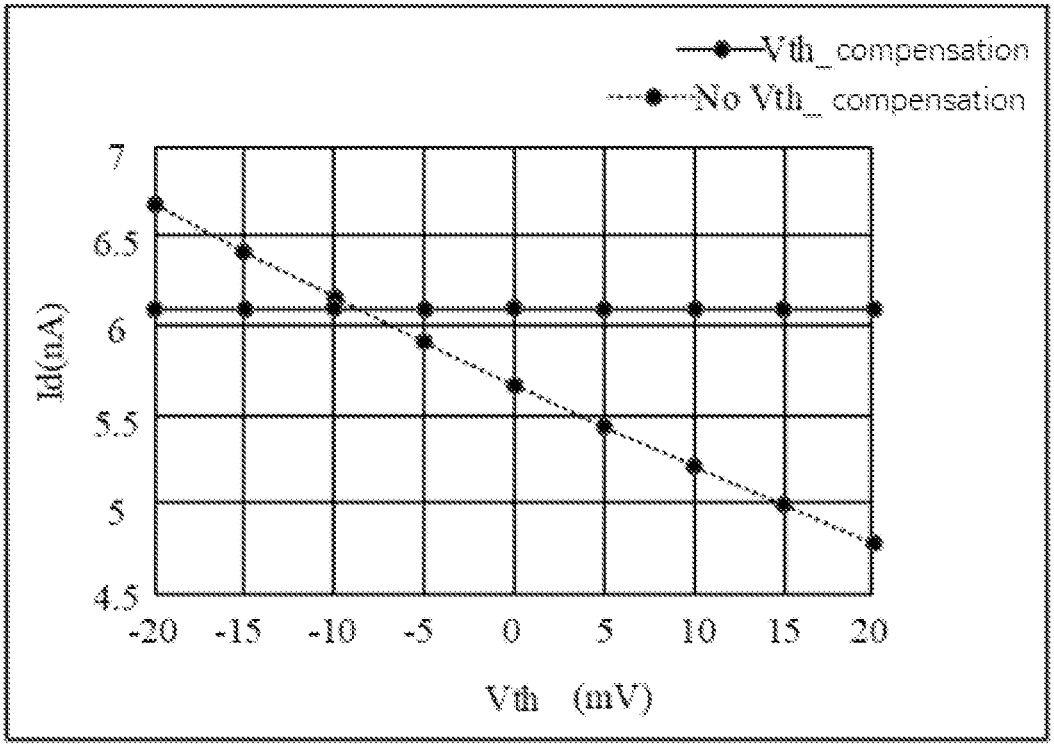
FIG. 3 is a graph comparing a first corresponding relationship between a threshold voltage and a driving current of a pixel circuit of an embodiment of the present disclosure and a second corresponding relationship between a threshold voltage and a driving current of a pixel circuit having no threshold compensation function.
Figure 4:
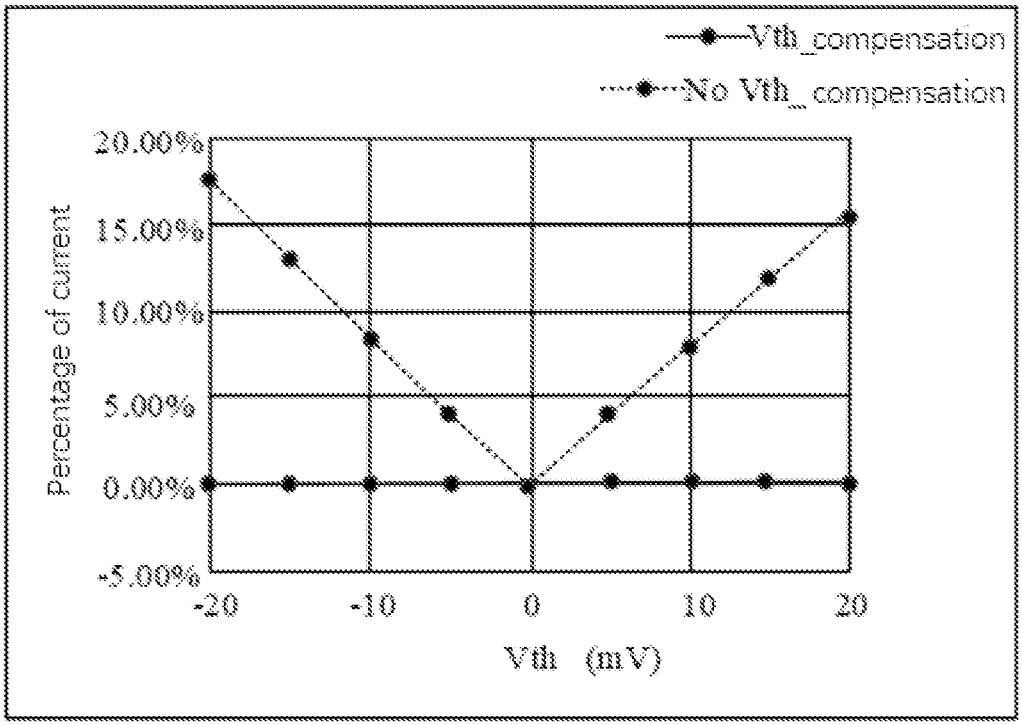
FIG. 4 is a graph comparing a third corresponding relationship between the threshold voltage and a percentage of the driving current of the pixel circuit of the embodiment of the present disclosure and a fourth corresponding relationship between the threshold voltage and a percentage of the driving current of the pixel circuit having no threshold compensation function.

FIG. 3 is a graph comparing a first corresponding relationship between a threshold voltage and a driving current of a pixel circuit of an embodiment of the present disclosure and a second corresponding relationship between a threshold voltage and a driving current of a pixel circuit having no threshold compensation function. The horizontal coordinate of FIG. 3 shows the variation of the threshold voltage Vth (mV), and the longitudinal coordinate is the driving current Id(nA). FIG. 4 is a graph comparing a third corresponding relationship between the threshold voltage and a percentage of the driving current of the pixel circuit of the embodiment of the present disclosure and a fourth corresponding relationship between the threshold voltage and a percentage of the driving current of the pixel circuit having no threshold compensation function. The horizontal coordinate of FIG. 4 shows the variation of the threshold voltage Vth(mV), the longitudinal coordinate is the variation percentage of the driving current. As shown in FIG. 3 and FIG. 4, in the pixel circuit without threshold compensation function, the variation range of the driving current Id is large when the threshold voltage varies, which will result in a large variation range of the display brightness. While in the pixel circuit having the threshold compensation function according to the embodiment of the present disclosure, the variation range of the driving current is smaller when the threshold voltage varies, that is, the pixel circuit according to the embodiment of the present disclosure is not sensitive to the variation of the threshold voltage of the driving transistor. When the variation range of the threshold voltage is ±20 mV, the current Id stays almost unchanged, that is, the light-emitting current is not related to the threshold voltage of the driving transistor MD. Therefore, the display effect of the display panel according to the embodiment of the present disclosure will be unimpacted by the variation of the threshold voltage, the display effect is more stable.

Figure 5:
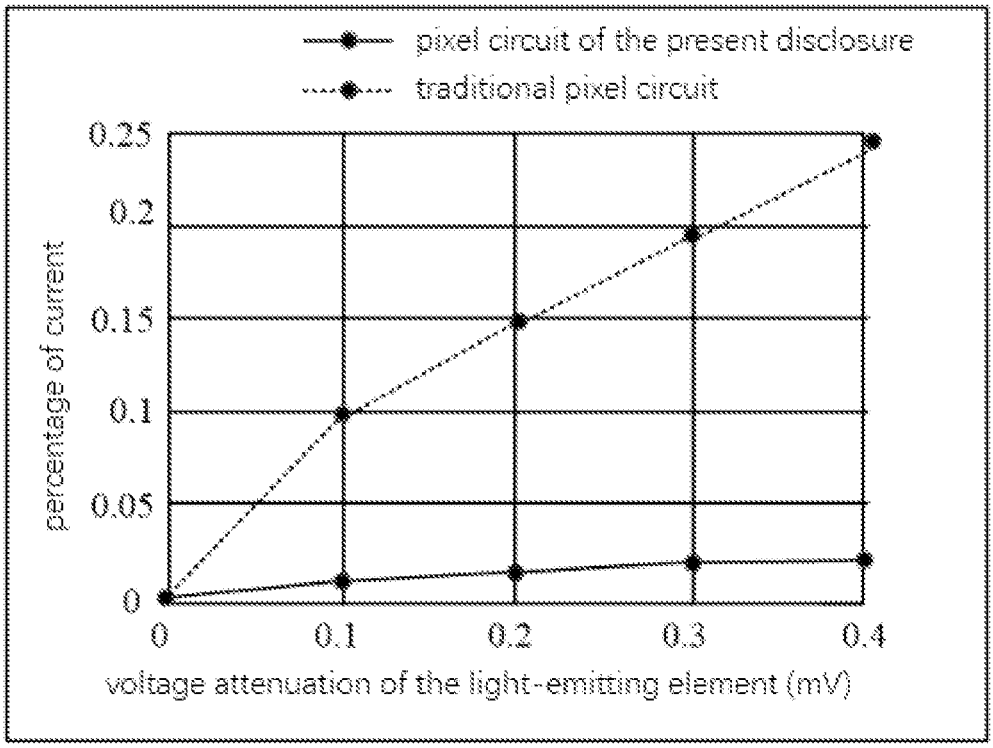
FIG. 5 is a graph comparing attenuation inhibition effect to light-emitting element in the pixel circuit of the embodiment of the present disclosure and attenuation inhibition effect to light-emitting element in a traditional pixel circuit.

FIG. 5 is a graph comparing attenuation inhibition effect to light-emitting element in the pixel circuit of the embodiment of the present disclosure and attenuation inhibition effect to light-emitting element in a traditional pixel circuit. The horizontal coordinate is the attenuation voltage or voltage decay of the light-emitting element, and the longitudinal coordinate is the percentage of the current variation after the light emitted by the light-emitting element attenuates. As shown in FIG. 5, when the attenuation voltage of the light-emitting element 22 varies from 0-0.4 mV, the driving current also varies. However, the current variation of the pixel circuit 21 of the embodiment of the present disclosure is smaller than that of the traditional pixel circuit. That is, the pixel circuit 21 of the embodiment of the present disclosure can decrease the display non-uniformity caused by the attenuation of the light emitted by the light-emitting element 22.

Furthermore, the display panel of the present embodiment can realize the compensation to the threshold voltage of the driving transistor MD through the first signal module 30 instead of a complex compensation circuit. Compared to the pixel circuit having the threshold compensation function in the prior art, the pixel circuit of the embodiment has a simple structure and a small size, and increases the resolution of the display panel.

It should be understood that, the structures of the reset module 211, the data-writing module 212, the light-emitting control module 213, the first memory module 214 and the first signal module 30 are not specifically limited to exemplary structures. Based on that the compensation function to the threshold voltage of the driving transistor MD can be realized, each module can be designed according to actual requirements.

In some embodiments, the substrate of the display panel includes a silicon substrate. Therefore, the pixel circuit is produced on single-crystal silicon, using SMIC 110 nm CMOS (Complementary Metal Oxide Semiconductor) technology.

Figure 6:
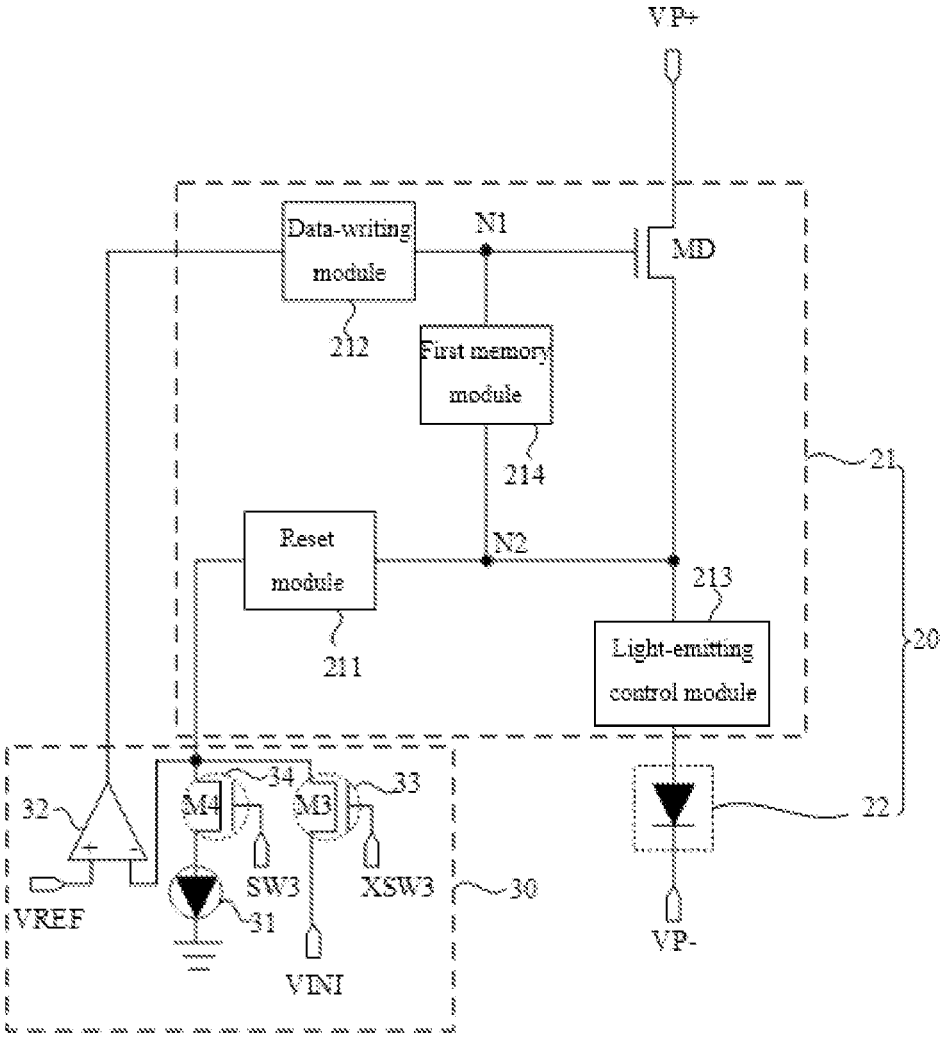
FIG. 6 is a structural schematic diagram of a part of a display panel according to an embodiment of the present disclosure.

FIG. 6 is a structural view of a part of a display panel according to the embodiment of the present disclosure. As shown in FIG. 6, the first signal module 30 includes a constant current source 31, an operational amplifier 32, a third gating unit 33 and a fourth gating unit 34. A first end of the third gating unit 33 is configured to provide a reset signal Vini, a second end of the third gating unit 33, a second end of the fourth gating unit 34 and the reset module 211 are electrically connected to an inverse-phase input end of the operational amplifier 32; a first end of the fourth gating unit 34 is electrically connected to the constant current source 31, a normal phase input end of the operational amplifier 32 is configured to receive a reference voltage Vref, and an output end of the operational amplifier 32 is electrically connected to the data-writing module 212. The third gating unit 33 is configured to provide a reset signal Vini to the anode of the light-emitting element 22 through the reset module 211 and the light-emitting control module 213, in the reset stage. The constant current source 31 is configured to output the data voltage signal Vdata to the data-writing module 212 through the fourth gating unit 34 and the operational amplifier 32, to write the data voltage signal Vdata to the gate electrode of the driving transistor MD and the first end of the first memory module 214 through the data-writing module 212. The constant current source 31 is further configured to provide the data current signal ID to the driving transistor MD in the data-writing stage, to compensate the threshold voltage of the driving transistor to the second node N2.

Specifically, in the reset stage, the third gating unit 33 writes the received reset signal Vini to the anode of the light-emitting element 22 through the reset module 211 and the light-emitting control module 213 to reset the electrical potential of the anode of the light-emitting element 22.

In the data-writing stage, the fourth gating circuit 34 is turned on, the constant current source 31 outputs a data current signal ID corresponding to the gray scale of the sub-pixel to the inverse-phase input end of the operational amplifier 32, so the output end of the operational amplifier 32 outputs a data voltage signal Vdata required for display. The constant current source 31, the reset module 211, the driving transistor MD, the data-writing module 212 and the operational amplifier 32 together form a loop, and the current in the loop is the data current signal ID output from the constant current source 31. Therefore, the current $I_{MD}$ of the driving transistor MD is exactly equal to the data current signal ID. As the voltage on the gate electrode of the driving transistor MD is Vdata, the source electrode of the driving transistor MD will be self-adapted to a certain voltage, that is, the second node N2 is self-adapted to a certain voltage, so that $ID=I_{MD}=k*(Vdata-V_{N2}-Vth)^2$. Therefore, the voltage of the second node N2 includes the information of the threshold voltage Vth of the driving transistor MD. The voltage of the first node N1 and the voltage of the second node N2 are both stored in the first memory module 214, that is, the voltage range of the first memory module 214 is $Vdata-V_{N2}$.

In the light-emitting stage, the light-emitting control module 213 is turned on, the light-emitting current $I_{MD}$ at this time is: $I_{MD}=k*(Vdata-V_{N2}-Vth)^2$. As the voltage of the second node N2 includes the information of the threshold voltage Vth of the driving transistor MD, the threshold voltage compensation of the driving transistor MD is realized, the light-emitting element 22 is no longer impacted by the threshold voltage Vth, and thus the unity in display is improved.

Based on the above technical solution, optionally, as shown in FIG. 6, the third gating unit 33 includes a third transistor M3, and the fourth gating unit 34 includes a fourth transistor M4. A second electrode of the third transistor M3 and a second electrode of the fourth transistor M4 are both electrically connected to the reset module 211. A first electrode of the third transistor M3 is configured to receive the reset signal Vini, and a first electrode of the fourth electrode M4 is configured to receive the data current signal ID output from the constant current source 31. A gate electrode of the third transistor M3 is configured to receive a third control signal XSW3, and turning on the third transistor M3 in the reset stage according to the third control signal XSW3. A gate electrode of the fourth transistor M4 is configured to receive a fourth control signal SW3, and turn on the fourth transistor M4 in the data-writing stage according to the fourth control signal SW3.

The third control signal XSW3 is configured to control the turning on or turning off the third transistor M3, and thus to control whether the reset signal Vini is transmitted to the reset module 211. The fourth control signal SW3 is configured to control the turning on or turning off the fourth transistor M4, and thus to control whether the data current signal ID output from the constant current source 31 is transmitted to the loop. The third control signal XSW3 is a signal opposite to the fourth control signal SW3, that is, when the third transistor M3 is turned on, the fourth transistor M4 is turned off, or when the third transistor M3 is turned off, the fourth transistor M4 is turned on.

Figure 7:
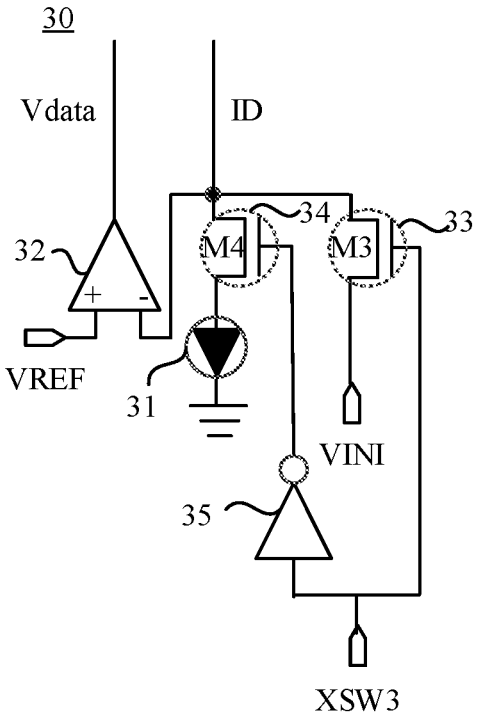
FIG. 7 is a structural schematic diagram of a first signal module according to an embodiment of the present disclosure.

FIG. 7 is a structural schematic view of the first signal module according to an embodiment of the present disclosure. The first signal module 30 further includes a second phase inverter 35. An input end of the second phase inverter 35 and a gate electrode of the third transistor M3 are both configured receive the third control signal XSW3, an output end of the second phase inverter 35 is electrically connected to the gate electrode of the fourth transistor M4.

In the illustrated embodiment, with the arrangement of the second phase inverter 35, the display panel can control the third transistor M3 and the fourth transistor M4 by only providing the control signal XSW3, instead of providing control signal lines separately for the third transistor M3 and the fourth transistor M4. Therefore, the layout of the display panel is simplified, the structure is simplified, and the producing efficiency of the display panel is increased. In addition, the number of the control ends on the chip for driving the pixel circuit can be decreased, and the cost of the chip can be saved.

Figure 8:
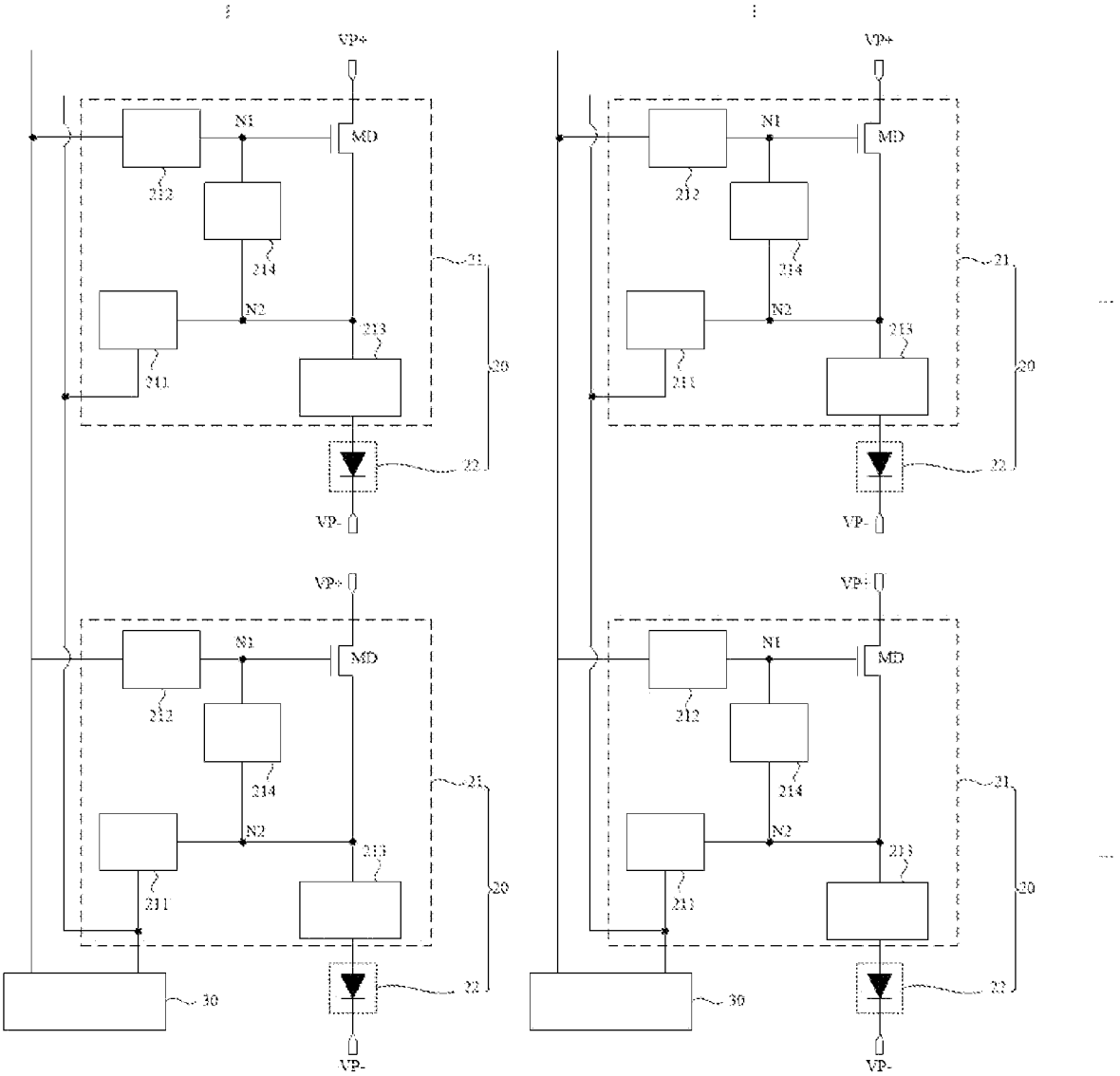
FIG. 8 is a structural schematic diagram of a part of another display panel according to an embodiment of the present disclosure.

FIG. 8 is a structural schematic view of another display panel according to an embodiment of the present disclosure. As shown in FIG. 8, data-writing modules 212 of each column of the sub-pixels 20 are all electrically connected to the first output end of a same first signal module 30, and reset modules 211 of each column of the sub-pixels 20 are all electrically connected to the second output end of a same first signal module 30. The advantages of this arrangement are: the number of the first signal modules 30 can be decreased, the producing steps of the display panel can be simplified, and the producing efficiency of the display panel can be improved.

It should be understood that, as the data current signal ID provided by the first signal module 30 is not a fixed value and has different values according to different gray scales. As illustrated in FIG. 8, the sub-pixels are driven line by line, the times to write the data voltage signal and the data current signal to two sub-pixels in adjacent lines and in a same column are different from each other. When the data-writing modules of the sub-pixels in each column are all electrically connected to a first output end of a same first signal module and the reset modules of the sub-pixels in each column are all electrically connected to a second output end of a same first signal module, the threshold voltage compensation can be realized while there is no signal crosstalk.

Figure 9:
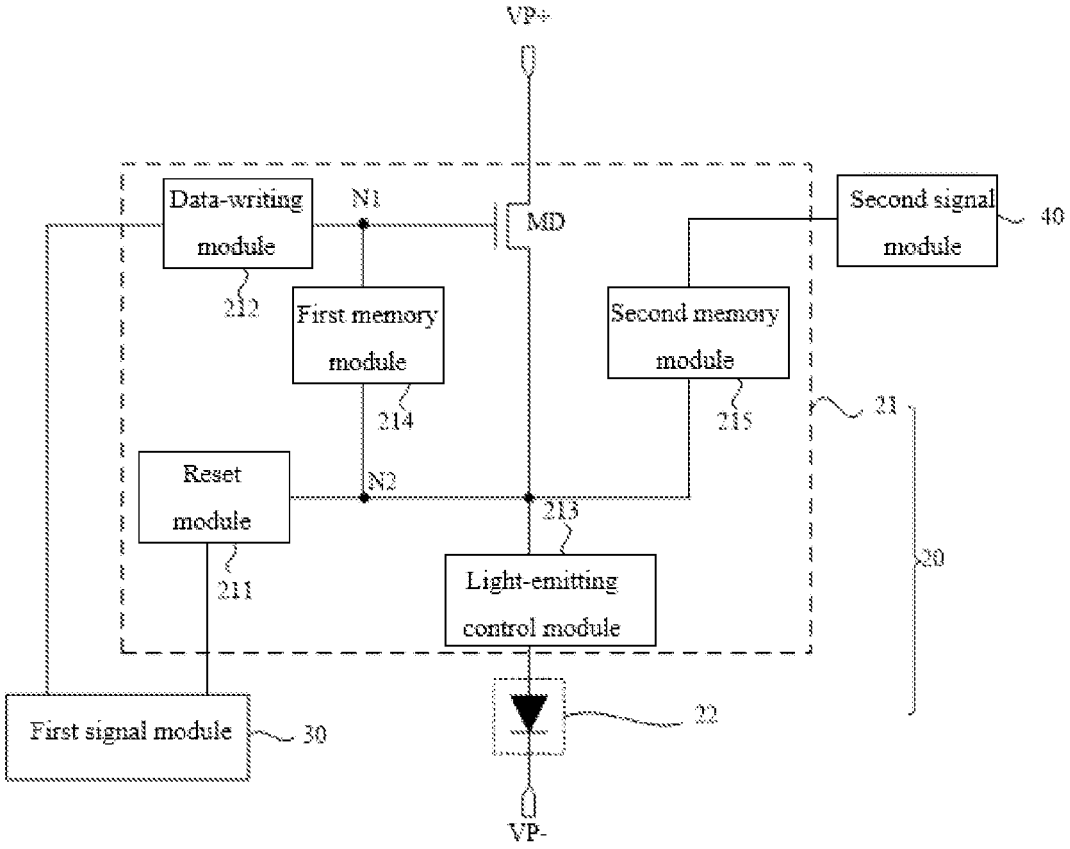
FIG. 9 is a structural schematic diagram of a part of another display panel according to an embodiment of the present disclosure.

FIG. 9 is a structural schematic view of another display panel according to an embodiment of the present disclosure. The display panel further includes a second signal module 40 for providing a jump signal, and the pixel circuit 21 further includes a second memory module 215, which has a first end electrically connected to the second signal module 40, and a second end electrically connected to the second node N2. The data-writing stage includes a first stage and a second stage. The second signal module 40 is configured to provide a first voltage signal V1 to the first end of the second memory module 215 in the reset stage and the first stage, and providing a second voltage signal V2 to the first end of the second memory module 215 in the second stage, to change the voltage signal of the second node N2; wherein the second voltage signal V2 is greater than the first voltage signal V1.

In one example embodiment wherein the driving transistor MD is a NMOS transistor, each of the first memory module 214 and the second memory module 215 is a capacitor, the operation principle is described below.

In a reset stage, the reset module 211 and the light-emitting control module 213 are turned on. The reset module 211 transmits a reset voltage to an anode of the light-emitting element 22 through the light-emitting control module 213 to reset the anode of the light-emitting element 22. The electrical potential of the first node N1 is equal to the electrical potential of the last frame (i.e., the last time of light-emitting). At the same time, the second signal module 40 provides a first fixed electrical potential V1 to the first end of the second memory module 215.

In the first stage, the data-writing module 212 and the reset module 211 are turned on. The first signal module 30 outputs the data voltage signal Vdata to the gate electrode of the driving transistor MD and the first end of the first memory module 214 through the data-writing module 212, that is, output to the first node N1. At this time, the data-writing module 212, the driving transistor MD, the reset module 211 and the first signal module 30 together form a loop. The first signal module 30 not only provides the data voltage signal Vdata required for display, but also provides a data current signal ID required for display after compensation. At this time, the current in the loop is the data current signal ID, that is, the current $I_{MD}$ of the driving transistor MD is equal to the data current signal ID. When the current $I_{MD}$ of the driving transistor MD is a fixed value, the source electrode of the driving transistor MD will be self-adapted to a certain voltage, that is, the second node N2 is self-adapted to a certain voltage, so that $ID=I_{MD}=k*(Vdata-V_{N2}-Vth)^2$, wherein the voltage of the second node N2 includes the information of the threshold voltage Vth of the driving transistor MD.

In the second stage, the data-writing module 212 is turned on. The electrical potential of the first node N1 is still equal to the data voltage signal Vdata. The second signal module 40 provides a second fixed electrical potential V2 to the first end of the second memory module 215 to control the electrical potential of the first end of the second memory module 215 to jump from the first fixed electrical voltage V1 to the second fixed electrical potential V2, that is, a voltage jump of ΔV is generated, wherein, $\Delta V=V2-V1$.

As the capacitor has a characteristic of charge conservation, if an electrical potential of one electrode of the capacitor varies, the electrical potential of another electrode of the capacitor will also varies under the coupling effect. Further, as the first memory module 214 is electrically connected to the second memory module 215 in series, when the electrical potential of a first end of the second memory module 215 varies for ΔV, the second node N2 varies for $C1*\Delta V/(C1+C2)$, wherein, C1 is the capacitance of the first memory module 214, C2 is the capacitance of the second memory module 215. The voltage range between the two ends of the first memory module 214 is $Vdata-V_{N2}-C1*\Delta V/(C1+C2)$. When the data-writing module 212 is turned off, the voltage of the first node N1 and the voltage of the second node N2 are stored in the first memory module 214 and the second memory module 215.

In the light-emitting stage, the light-emitting control module 213 is turned on, the first node N1 is floating, and the light-emitting current at this time is: $I_{MD}=k*(Vdata-V_{N2}-C1*\Delta V/(C1+C2)-Vth)^2$.

In the illustrated embodiment, as the voltage of the second node N2 includes the information of the threshold voltage Vth of the driving transistor MD, the threshold voltage compensation of the driving transistor MD is realized. In addition, the second signal module 40 raises the electrical potential of the second node N2 by $\Delta V/(C1+C2)$, therefore, the gate-source voltage Vgs is decreased by $\Delta V/(C1+C2)$ from the original voltage, therefore, the data range of the pixel circuit is increased, the gamma of 0-255 gray scale can be easily adjusted.

Figure 10:
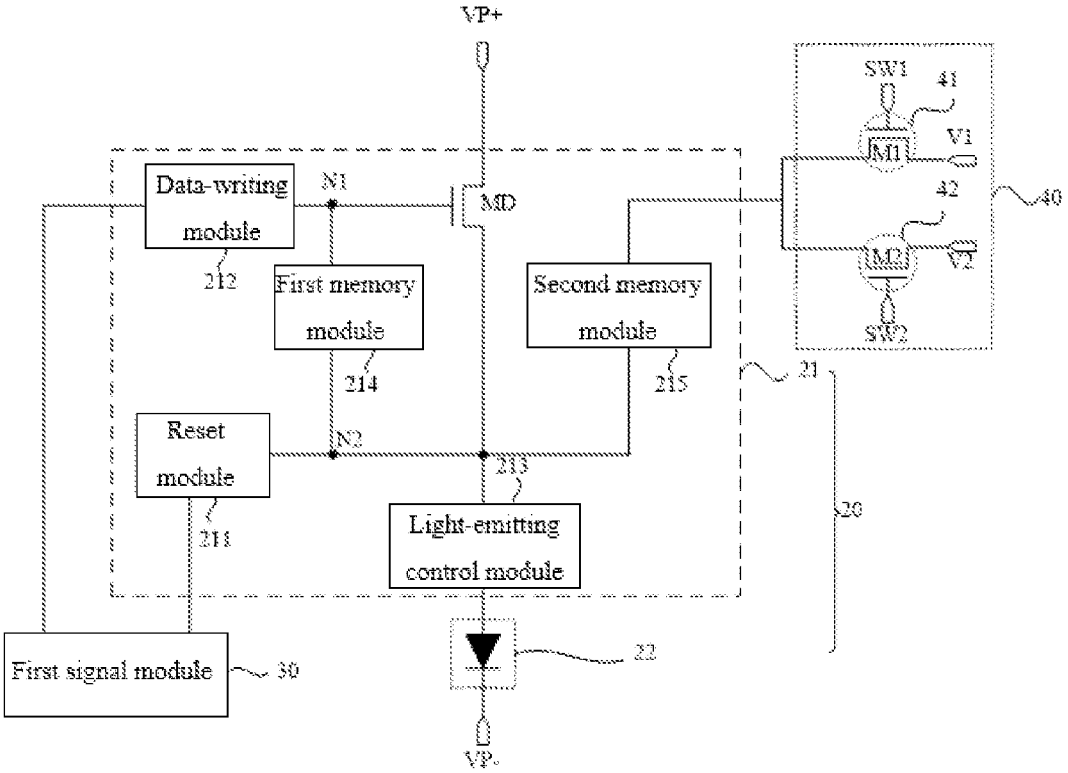
FIG. 10 is a structural schematic diagram of a part of another display panel according to an embodiment of the present disclosure.

FIG. 10 is a structural schematic diagram of another display panel according to an embodiment of the present disclosure. The second signal module 40 includes a first gating unit 41 and a second gating unit 42 connected to each other in parallel. The first gating unit used 41 is configured to provide the first voltage signal V1 to the first end of the second memory module 215 in the reset stage and the first stage. The second gating unit 42 is configured to provide the second voltage signal V2 to the first end of the second memory module 215 in the second stage. That is, different gating units separately provide the first voltage signal V1 and the second voltage signal V2 to the first end of the second memory module 215 in different stages, to make the voltage of the first end of the second memory module 215 jumps.

As shown in FIG. 10, the first gating unit 41 includes a first transistor M1 having a first electrode, a second electrode and a gate electrode, and the second gating unit 42 includes a second transistor M2 having a first electrode, a second electrode and a gate electrode. The second electrode of the first transistor M1 and the second electrode of the second transistor M2 are both electrically connected to the first end of the second memory module 215. The first electrode of the first transistor M1 is configured to receive the first voltage signal V1, and the first electrode of the second transistor M2 is configured to receive the second voltage signal V2. The gate electrode of the first transistor M1 is configured to receive a first control signal SW1 and turn on the first transistor M1 according to the first control signal SW1 in the reset stage and the first stage. The gate electrode of the second transistor M2 is configured to receive a second control signal SW2 and turn on the second transistor M2 according to the second control signal SW2 in the second stage.

The first control signal SW1 controls turning on or turning off the first transistor M1 to control whether the first voltage signal V1 is transmitted to the first end of the second memory module 215. The second control signal SW2 controls turning on or turning off the second transistor M2 to control whether the second voltage signal V2 is transmitted to the first end of the second memory module 215. The first control signal SW1 is a signal opposite to the second control signal SW2, that is, when the first transistor M1 is turned on, the second transistor M2 is turned off; or when the first transistor M1 is turned off, the second transistor M2 is turned on.

Figure 11:
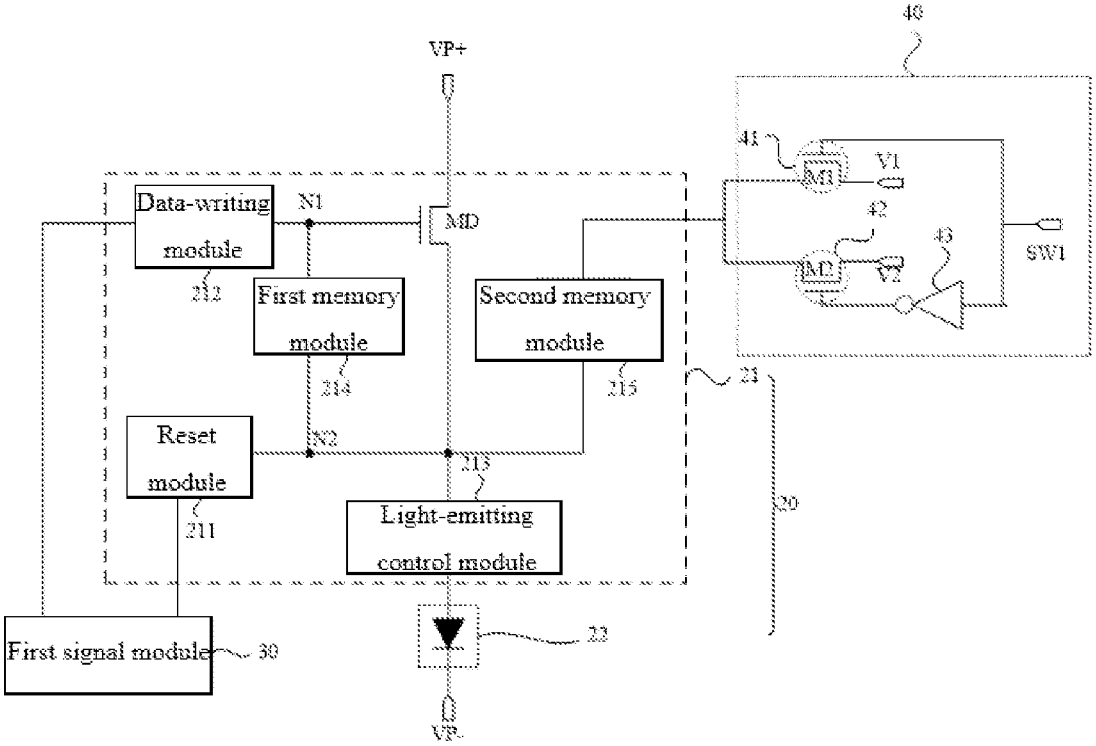
FIG. 11 is a structural schematic diagram of a part of another display panel according to an embodiment of the present disclosure.

FIG. 11 is a structural schematic diagram of another display panel according to an embodiment of the present disclosure. The second signal module 40 further includes a first phase inverter 43 having an input end and an output end. The input end of the first phase inverter 43 and the gate electrode of the first transistor M1 are configured to receive the first control signal SW1, and the output end of the first phase inverter 43 is electrically connected to the gate electrode of the second transistor M2.

In the illustrated embodiment, with the arrangement of the first phase inverter 43, the display panel can control the first transistor M1 and the second transistor M2 by only providing the control signal SW1 instead of providing control signal lines separately for the first transistor M1 and the second transistor M2. Therefore, the layout of the display panel is simplified, the structure is simplified, and the producing efficiency of the display is improved. In addition, the number of the control ends on the chip for driving the pixel circuit can be decreased, and the cost of the chip can be saved.

Figure 12:
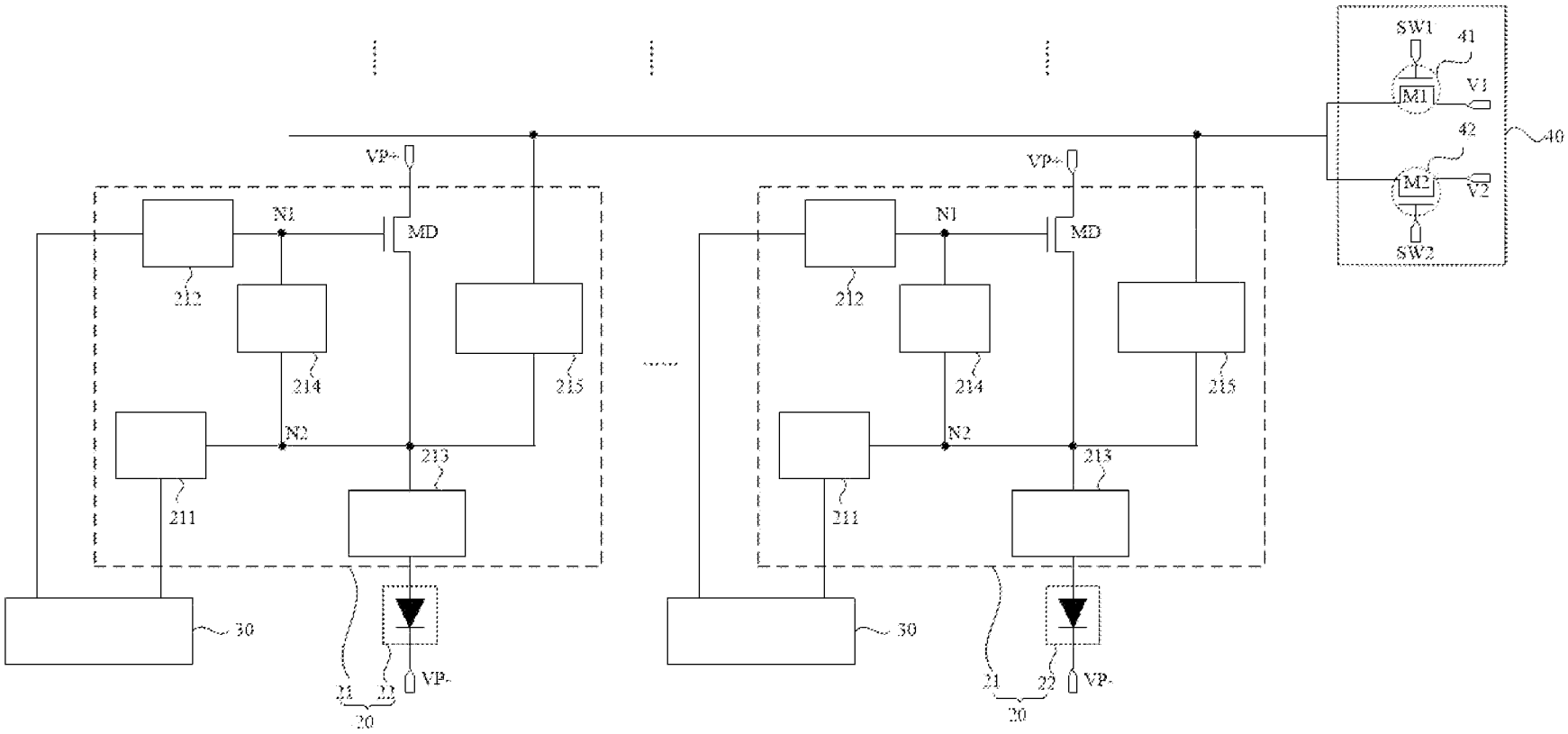
FIG. 12 is a structural schematic diagram of a part of another display panel according to an embodiment of the present disclosure.

FIG. 12 is a structural schematic diagram of another display panel according to an embodiment of the present disclosure. The first ends of the second memory modules 215 of the sub-pixels on a same line are all electrically connected to a same second signal module 40.

In the illustrated embodiment, as the first ends of the second memory modules 215 of the sub-pixels on a same line are all electrically connected to a same second signal module 40, the second signal module 40 is capable of providing the first voltage signal V1 to the first ends of the second memory modules 215 of the sub-pixels on a same line in the reset stage and the first stage, and providing the second voltage signal V2 to the first ends of the second memory modules 215 of the sub-pixels on a same line. Therefore, the number of the second signal modules in the display panel can be decreased, the producing steps of the display panel are simplified, and the producing efficiency of the display panel is improved. In addition, the synchronicity of the first ends of the second memory modules 215 of the sub-pixels on a same line receiving the first voltage signal V1 and the second voltage signal V2 is ensured.

Figure 13:
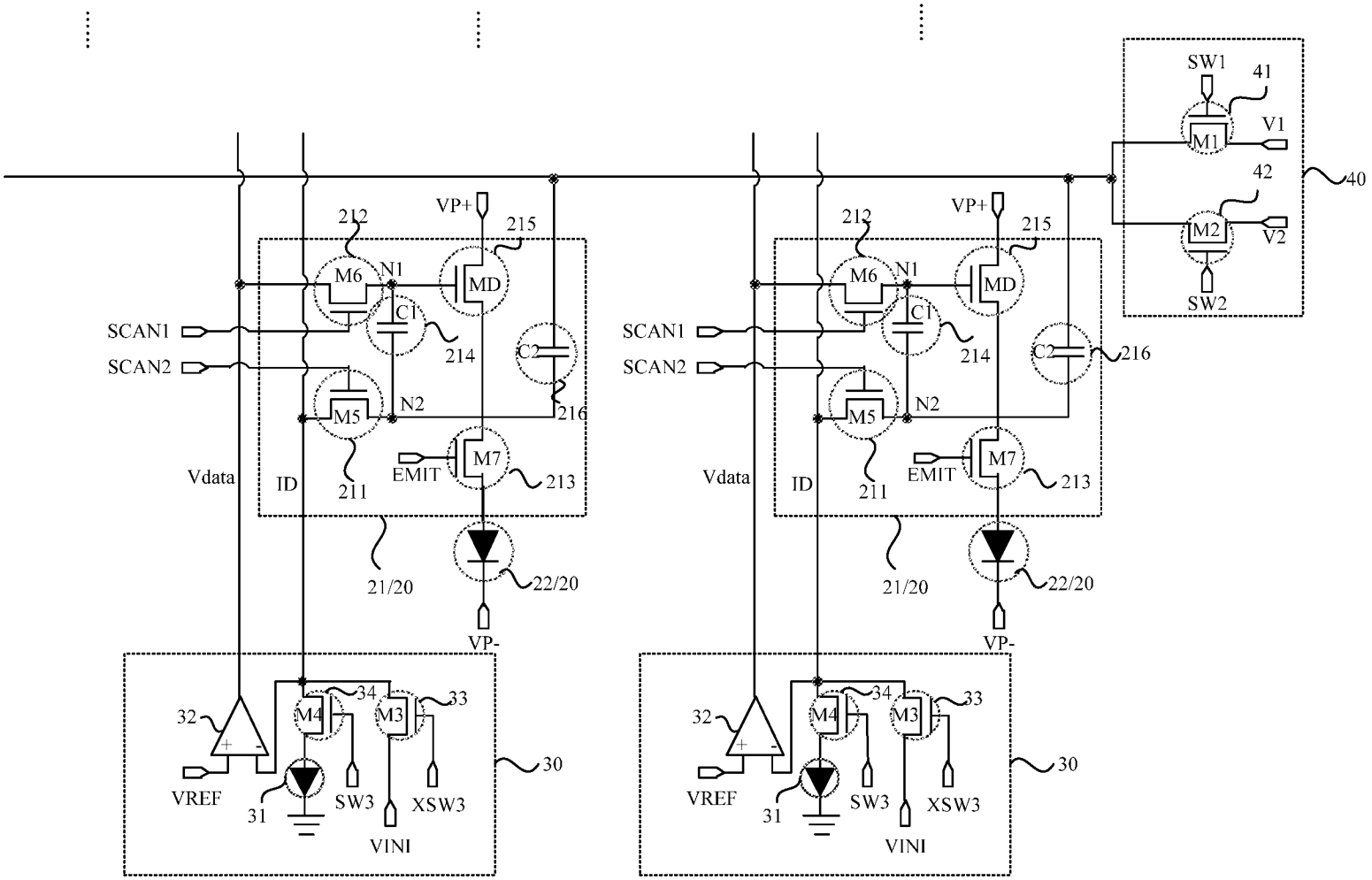
FIG. 13 is a structural schematic diagram of a part of another display panel according to an embodiment of the present disclosure.

FIG. 13 is a structural schematic diagram of another display panel according to an embodiment of the present disclosure. The reset module 211 includes a fifth transistor M5. The data-writing module 212 includes a sixth transistor M6. The light-emitting control module 213 includes a seventh transistor M7. The first memory module 214 includes a first capacitor C1, and the second memory module 215 includes a second capacitor C2. The fifth transistor M5 has a first electrode electrically connected to the second output end of the first signal module 30, a second electrode electrically connected to the second node N2, and a gate electrode electrically connected to a second scan signal end SCAN2. The sixth transistor M6 has a first electrode electrically connected to the first output end of the first signal module 30, a second electrode electrically connected to the gate electrode of the driving transistor MD, and a gate electrode electrically to a first scan signal end SCAN1. A second electrode of the driving transistor MD is electrically connected to a first power source end VP+. The seventh transistor M7 has a first electrode connected to the second node N2, a second electrode electrically connected to the anode of the light-emitting element 22, and a gate electrode electrically connected to a light-emitting control signal end EMIT. The cathode of the light-emitting element 22 is electrically connected to a second power signal end VP−.

It should be understood that FIG. 13 shows an example in which each module includes a transistor, and each memory module includes a capacitor. That is, the pixel circuit 21 shown in FIG. 13 is a 4T2C (4 transistors and 2 memory capacitors) circuit, but the structure of the pixel circuit 21 is not limited to this, other structures can realize the driving of the pixels can also be used.

In the illustrated embodiment, each transistor may be a PMOS transistor, or a NMOS transistor, the embodiment of the present disclosure has no limit to this. Taking the pixel circuit 21 being a 4T2C circuit as an example, the transistors, the third gating unit 33 and the fourth gating unit 34 in the pixel circuit 21 are all NMOS transistors and the first gating unit 41 and the second gating unit 42 are both PMOS transistors. The working principle of the first signal module 30, the second signal module 40 and the pixel circuit 21 are described in detail.

Figure 14:
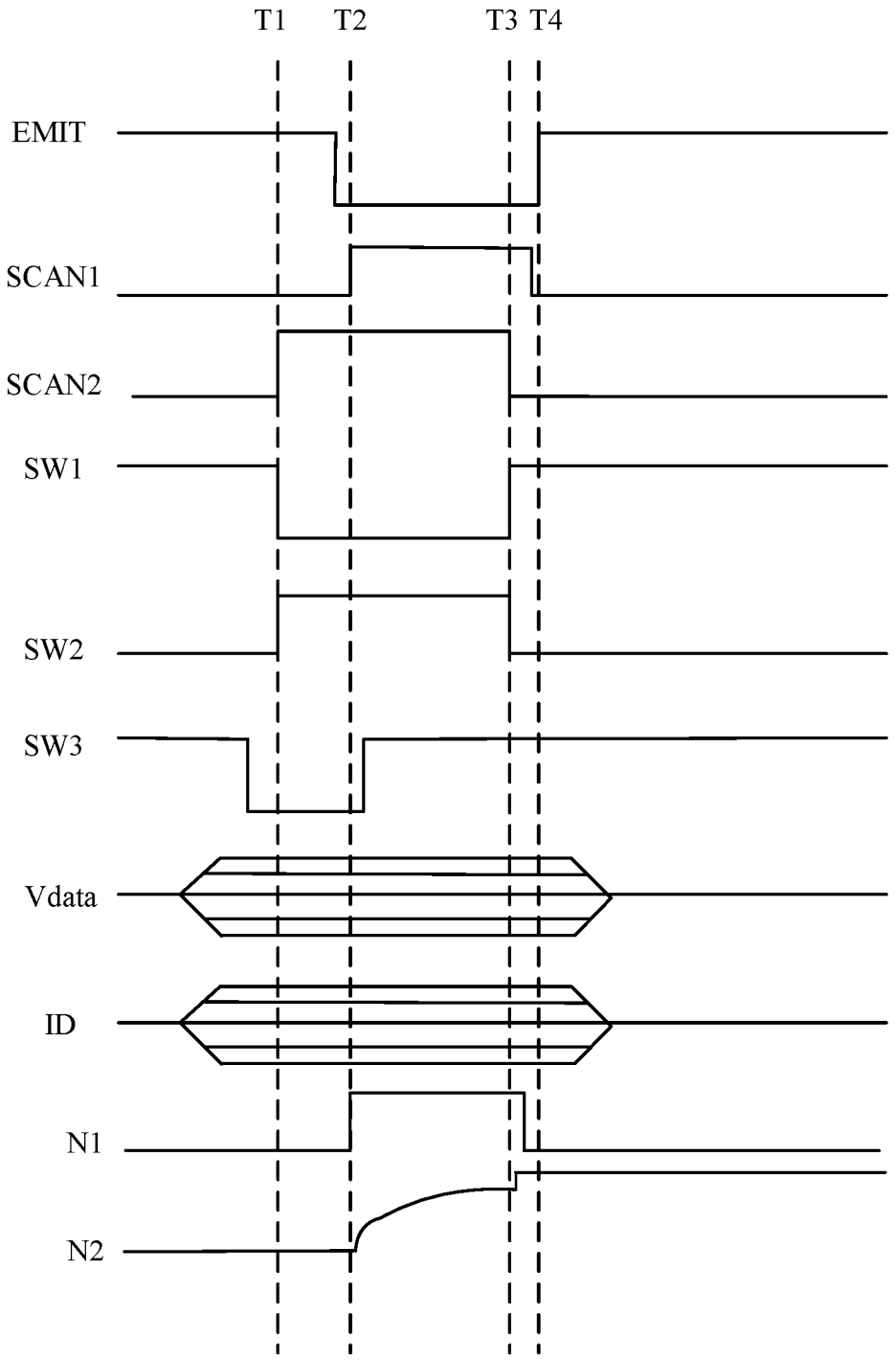
FIG. 14 is a sequence diagram of a pixel circuit, a second signal module and a first signal module according to an embodiment of the present disclosure.

FIG. 14 is a sequence diagram of the pixel circuit, the second signal module and the first signal module according to the embodiment of the present disclosure. Referring to FIG. 13 and FIG. 14, in the time period from T1 to T2 (i.e., in the reset stage), the first control signal SW1 received by the gate electrode of the first transistor M1, the first scan signal SCAN1 received by the gate electrode of the sixth transistor M6 and the fourth control signal SW3 received by the gate electrode of the fourth transistor M4 are all low-level signals. The second control signal SW2 received by the gate electrode of the second transistor M2, the light-emitting control signal Emit received by the gate electrode of the seventh transistor M7, the third control signal XSW3 received by the gate electrode of the third transistor M3 and the second scan signal SCAN2 received by the gate electrode of the fifth transistor M5 are all high-level signals. At this time, the first transistor M1, the seventh transistor M7, and the third transistor M3 and the fifth transistor M5 are turned on, the third transistor M3 writes the received reset signal Vini to the anode of the light-emitting element 22 through the fifth transistor M5 and the seventh transistor M7 to reset the electrical potential of the anode of the light-emitting element 22. The first node N1 has an electrical potential the same with the last frame. At the same time, the first transistor M1 provides a first fixed electrical potential V1 to the first electrode of the second capacitor C2.

In the time period from T2 to T3 (i.e., in the first stage), the first control signal SW1 received by the gate electrode of the first transistor M1, the third control signal XSW3 received by the gate electrode of the third transistor M3 and the light-emitting control signal Emit received by the gate electrode of the seventh transistor M7 are all low-level signals. The second control signal SW2 received by the gate electrode of the second transistor M2, the fourth control signal SW3 received by the gate electrode of the fourth transistor M4, the second scan signal SCAN2 received by the gate electrode of the fifth transistor M5 and the first scan signal SCAN1 received by the gate electrode of the sixth transistor M6 are all high-level signals. At this time, the first transistor M1, the fourth transistor M4, the sixth transistor M6 and the fifth transistor M5 are turned on. The constant current source 31 outputs a data current signal ID corresponding to the gray scale of the sub-pixel to the inverse-phase input end of the operational amplifier 32, so that the output end of the operational amplifier 32 outputs a data voltage signal Vdata required for display, the constant current source 31, the sixth transistor M6, the driving transistor MD, the fifth transistor M5 and the operational amplifier 32 together form a loop. The current in the loop is the data current signal ID output from the constant current source 31. Therefore, the current $I_{MD}$ of the driving transistor MD is exactly equal to the data current signal ID. As the voltage on the gate electrode of the driving transistor MD is Vdata, the source electrode of the driving transistor MD will be self-adapted to a certain voltage, that is, the second node N2 is self-adapted to a certain voltage, so that $ID=I_{MD}=k*(Vdata-V_{N2}-Vth)^2$. The voltage of the second node N2 includes the information of the threshold voltage Vth of the driving transistor MD. The voltage of the first node N1 and the voltage of the second node N2 are both stored in the first memory module 214, that is, the voltage range of the first memory module 214 is $Vdata-V_{N2}$.

In the time period from T3 to T4 (i.e., in the second stage), the second control signal SW2 received by the gate electrode of the second transistor M2, the third control signal XSW3 received by the gate electrode of the third transistor M3, the second scan signal SCAN2 received by the gate electrode of the fifth transistor M5 and the light-emitting control signal Emit received by the gate electrode of the seventh transistor M7 are all low-level signals. The first control signal SW1 received by the gate electrode of the first transistor M1, the fourth control signal SW3 received by the gate electrode of the fourth transistor M4, and the first scan signal SCAN1 received by the gate electrode of the sixth transistor M6 are all high-level signals. At this time, the second transistor M2, the fourth transistor M4 and the sixth transistor M6 are turned on. The electrical potential of the first node N1 is still equal to the data voltage signal Vdata. The second transistor M2 provides a second fixed electrical potential V2 to the first electrode of the second capacitor C2. Therefore, the electrical potential of the first electrode of the second capacitor C2 jumps from the first fixed electrical voltage V1 to the second fixed electrical potential V2, that is, a voltage jump of $\Delta V$ is generated, wherein $\Delta V=V2-V1$. The second node N2 jumps $C1*\Delta V/(C1+C2)$ correspondingly, wherein C1 is the capacitance of the first capacitor C1, C2 is the capacitance of the second capacitor C2. The voltage range between the two ends of the first capacitor C1 is $Vdata-V_{N2}-C1*\Delta V/(C1+C2)$. When the sixth transistor M6 is turned off, the voltage of the first node N1 and the voltage of the second node N2 are stored in the first capacitor C1 and the second capacitor C2.

In the time period from T4 (i.e., the light-emitting stage), the second control signal SW2 received by the gate electrode of the second transistor M2, the third control signal XSW3 received by the gate electrode of the third transistor M3, the second scan signal SCAN2 received by the gate electrode of the fifth transistor M5 and the first scan signal SCAN1 received by the gate electrode of the sixth transistor M6 are all low-level signals. The first control signal SW1 received by the gate electrode of the first transistor M1, the fourth control signal SW3 received by the gate electrode of the fourth transistor M4, and the light-emitting control signal Emit received by the gate electrode of the seventh transistor M7 are all high-level signals. At this time, the seventh transistor M7 is turned on, and the light-emitting current is: $I_{MD}=k*(Vdata-V_{N2}-Vth)^2$. As the voltage of the second node N2 includes the information of the threshold voltage Vth of the driving transistor MD, the threshold voltage compensation of the driving transistor MD is realized, the light-emitting element 22 is not impacted by the threshold voltage Vth, the unity in display is improved. Even if the light emitted by the light-emitting element attenuates and the voltage of the second node floats, the voltage of the first node will change correspondingly under the coupling effect of the capacitor C1 to inhibit the attenuation influence of the light emitted by the light-emitting element, thus the uniformity of the display panel will be improved. In addition, because the first electrode of the second capacitor C2 connected to the voltage is capable of jumping, the electrical potential of the second node N2 is raised by $\Delta V/(C1+C2)$, therefore, the gate-source voltage Vgs is decreased by subtracting ΔV/(C1+C2) from the original voltage, therefore, the data range of the pixel circuit is increased and the gamma of 0-255 gray scale can be easily adjusted.

Figure 15:
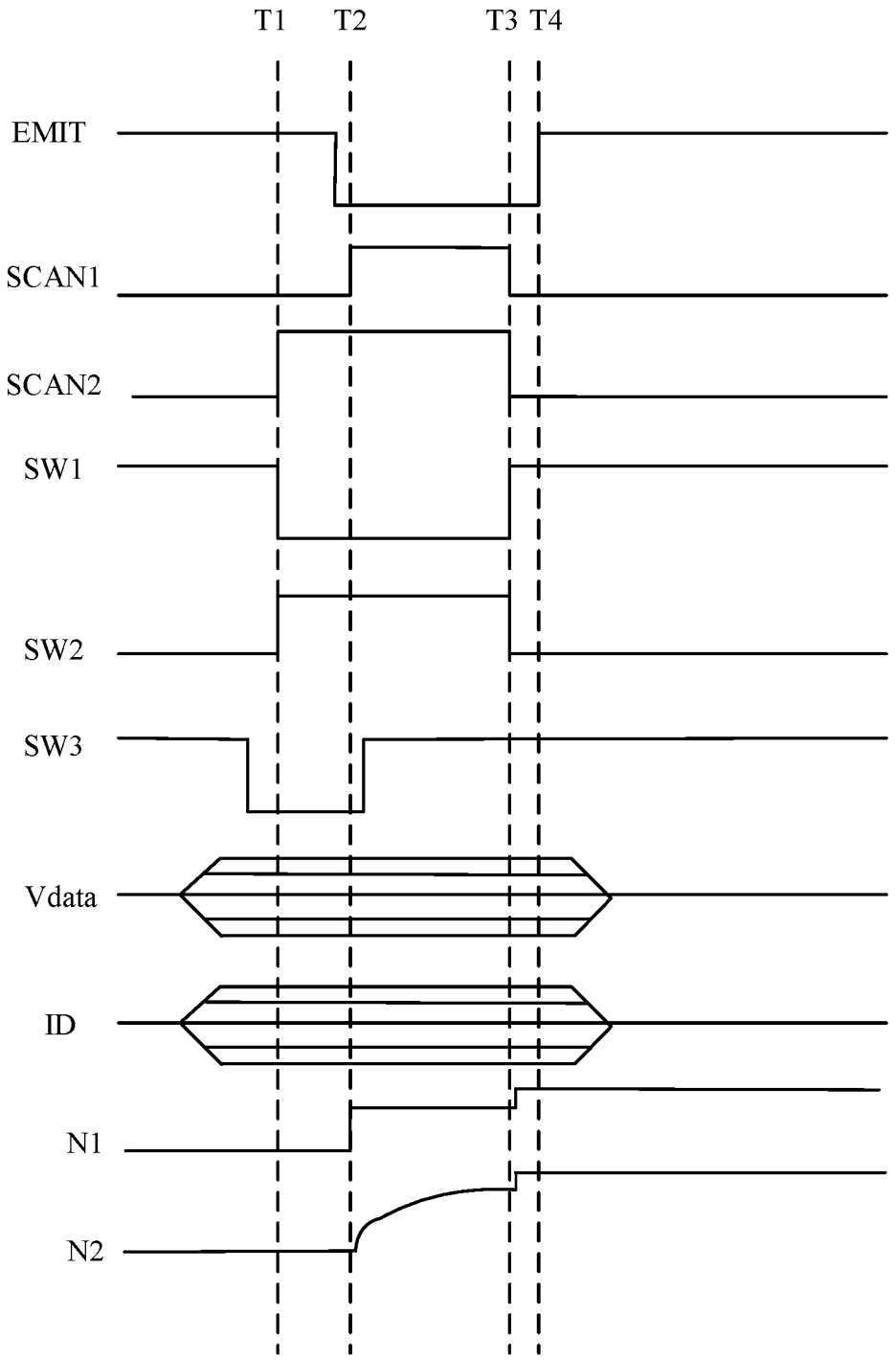
FIG. 15 is another sequence diagram of a pixel circuit, a second signal module and a first signal module according to the embodiment of the present disclosure.

It should be understood that, under the premise of the functions of the pixel circuit, the second signal module and the first signal module can be realized, the sequence view of the pixel circuit, the second signal module and the first signal module is not limited to FIG. 14. For example, the sequence view of the pixel circuit, the second signal module and the first signal module can also be FIG. 15.

Optionally, the first voltage signal V1 is a first power signal VP1 transmitted by the first power signal end VP+; or the second voltage signal V2 is a second power signal VP2 transmitted by the second power signal end VP−. The arrangement has the advantages that there is no need to provide separate signal lines for the first voltage signal V1 or the second voltage signal V2, the structure of the pixel circuit is simplified, and the producing efficiency of the display panel is improved.

Optionally, the first capacitor C1 can be a MIN capacitor or a MOS capacitor, and the second capacitor C2 can be a MIN capacitor. It should be understood, the types of the first capacitor C1 and the second capacitor C2 are not limited to this, those skilled in the art can choose the types of the capacitors according to actual situations, and not limited to the embodiment.

Figure 16:
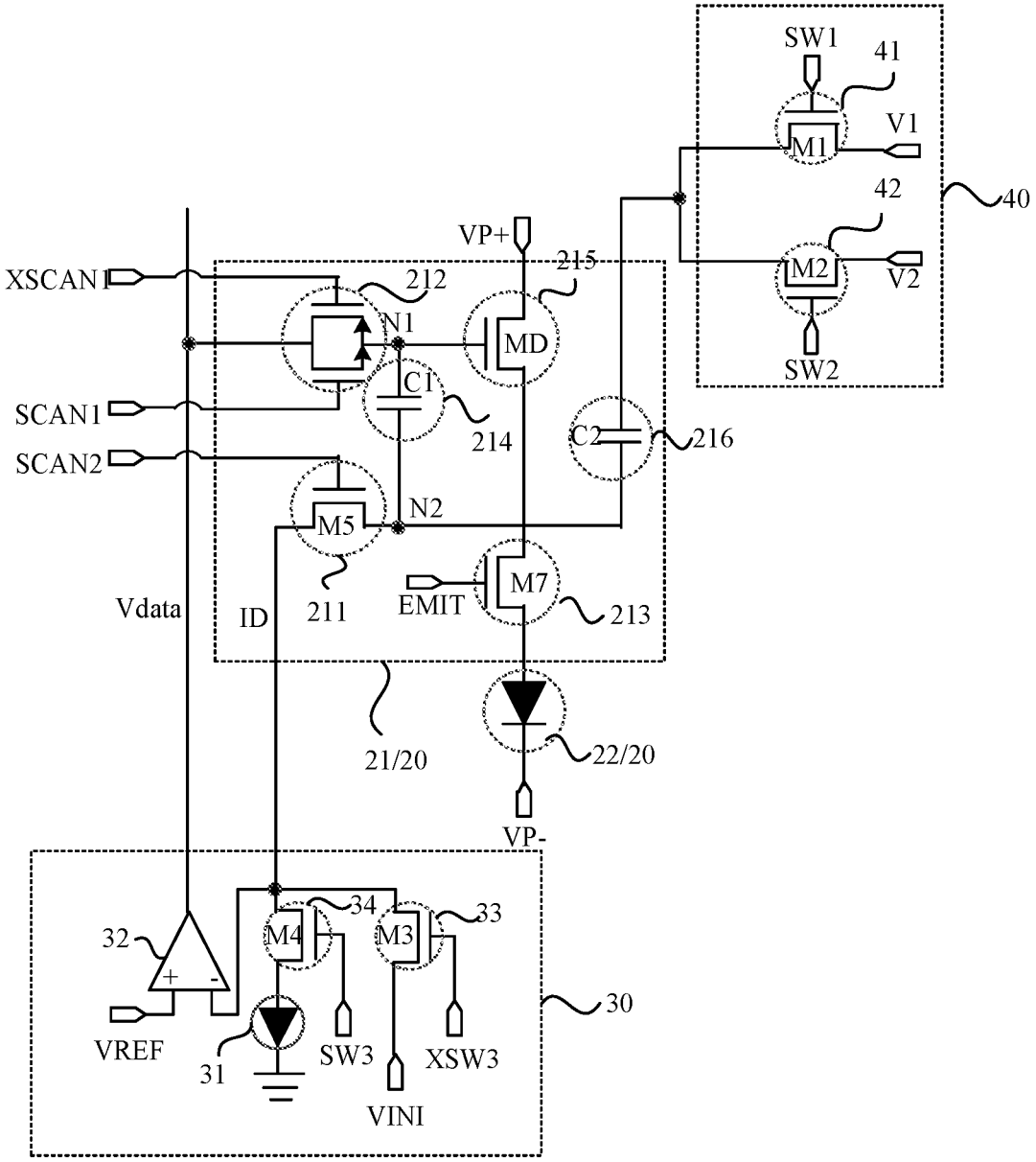
FIG. 16 is a structural schematic diagram of a part of another kind of display panel according to the embodiment of the present disclosure.

FIG. 16 is a structural schematic diagram of another display panel according to an embodiment of the present disclosure. The data-writing module 212 includes a transmission gate having a N-type transistor and a P-type transistor, a first electrode of the N-type transistor and a first electrode of the P-type transistor are both electrically connected to the first output end of the first signal module 30, a second electrode of the N-type transistor and a second electrode of the P-type transistor are both electrically connected to the first node N1, a gate node of the N-type transistor is electrically connected to a first scan signal end SCAN1, a gate electrode of the P-type transistor is electrically connected to a third scan signal end XSCAN1. A first scan signal transmitted by the first scan signal end SCAN1 is opposite to a third scan signal transmitted by the third scan signal end XSCAN1 at the same time. The arrangement of the transmission gate in the data-writing module 212 has the advantage of decreasing the voltage scope of the gate electrode of the switch transistors, and increasing the writing range of the data voltage signal Vdata.

Figure 17:
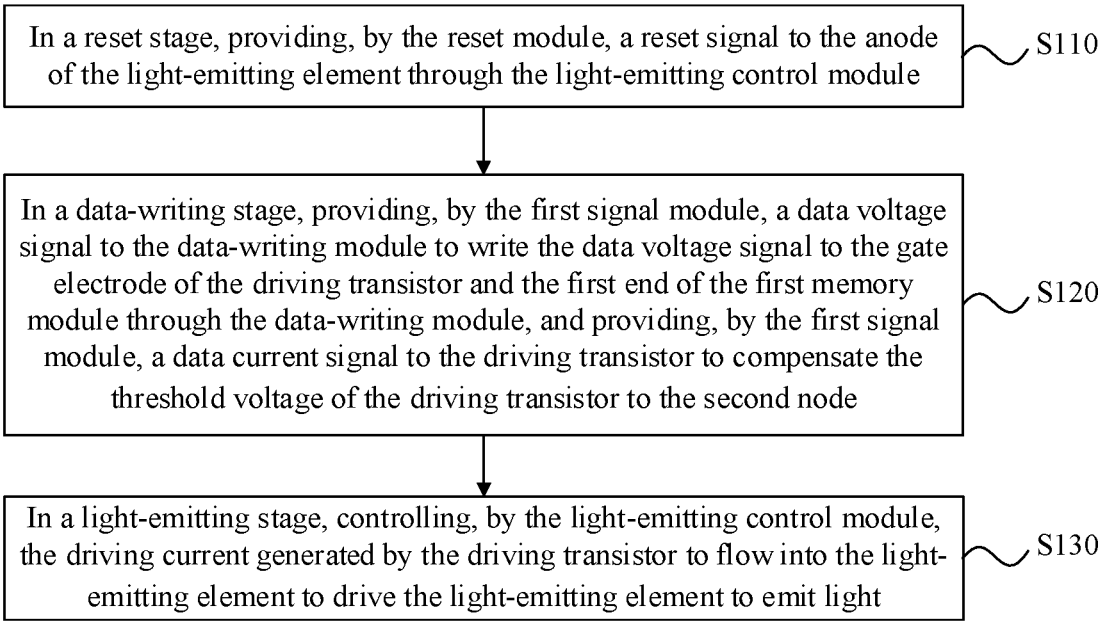
FIG. 17 is a flow chart of a driving method of a display panel according to an embodiment of the present disclosure.

Based on a same concept with the above display panel, the present disclosure further provides a driving method of a display panel. The method can be applied to drive the display panel described above. The technical features not described in detail here can refer to the features in the embodiments of the display panel described above. As shown in FIG. 17, the method for driving the display panel includes the following steps:

S110: in a reset stage, providing, by the reset module, a reset signal to the anode of the light-emitting element through the light-emitting control module;

S120: in a data-writing stage, providing, by the first signal module, a data voltage signal to the data-writing module to write the data voltage signal to the gate electrode of the driving transistor and the first end of the first memory module through the data-writing module, and providing, by the first signal module, a data current signal to the driving transistor to compensate the threshold voltage of the driving transistor to the second node;

S130: in a light-emitting stage, controlling, by the light-emitting control module, the driving current generated by the driving transistor to flow into the light-emitting element to drive the light-emitting element to emit light.

By using the driving method of a display panel, the first signal module provides a data voltage signal to the data-writing module to write the data voltage signal to the gate electrode of the driving transistor and the first end of the first memory module through the data-writing module, and the first signal module provides a data current signal to the driving transistor to compensate the threshold voltage of the driving transistor to the second voltage to realize the threshold voltage compensation. In addition, when the first memory module is a capacitor, even if the light emitted by the light-emitting element attenuates and the voltage of the second node floats, the voltage of the first node will change along under the coupling effect of the capacitor to inhibit the attenuation influence of the light emitted by light-emitting element, therefore the uniformity of the display panel will be improved.

Figure 18:
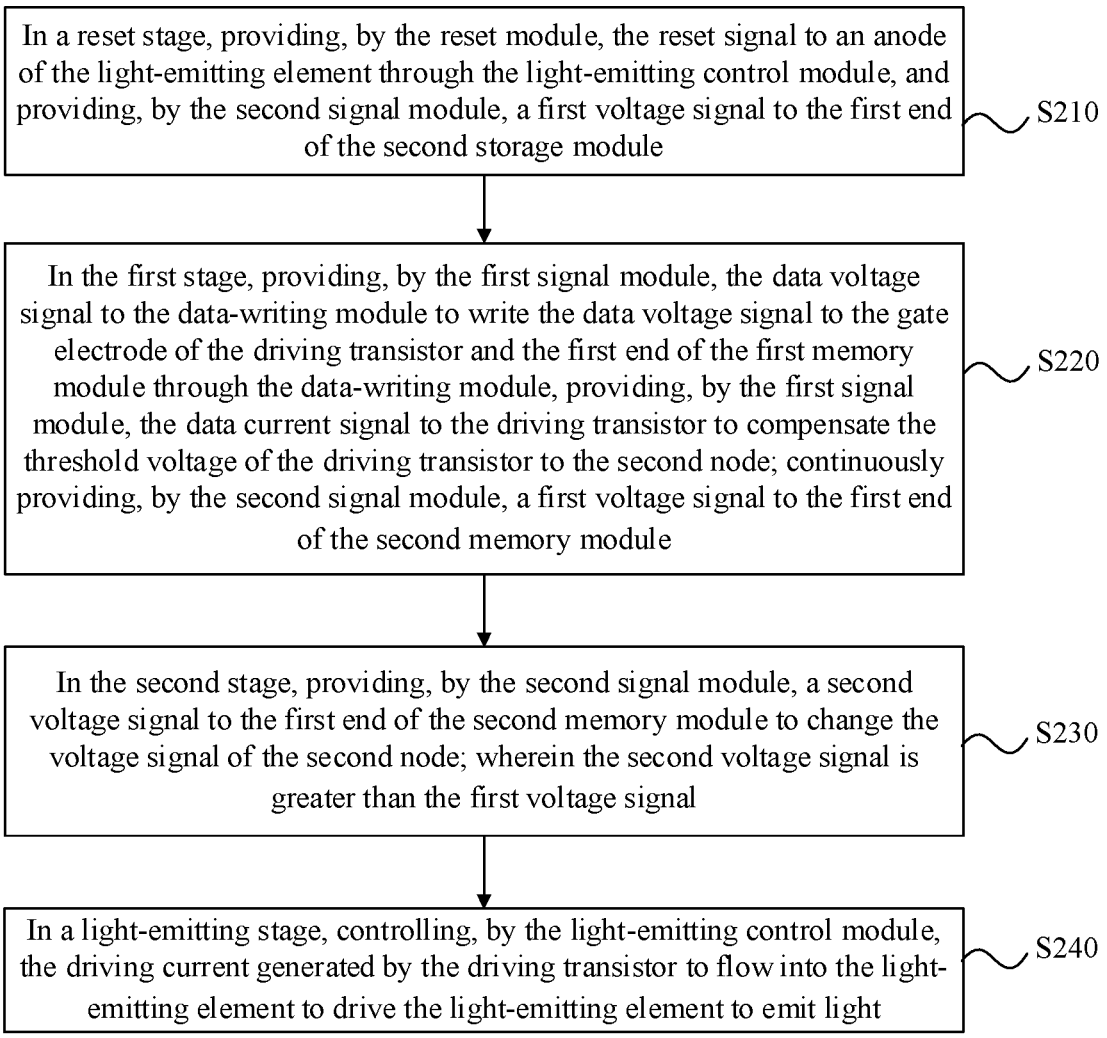
FIG. 18 is a flow chart of another kind of driving method of a display panel according to an embodiment of the present disclosure.

In one embodiment, the display panel further includes at least one second signal module for providing a jump signal, the pixel circuit further includes a second memory module, and the data-writing stage includes a first stage and a second stage. FIG. 18 is a flow chart of another driving method of a display panel of the present disclosure. The method comprises:

S210: in a reset stage, providing, by the reset module, the reset signal to an anode of the light-emitting element through the light-emitting control module, and providing, by the second signal module, a first voltage signal to the first end of the second storage module;

S220: in the first stage, providing, by the first signal module, the data voltage signal to the data-writing module to write the data voltage signal to the gate electrode of the driving transistor and the first end of the first memory module through the data-writing module, providing, by the first signal module, the data current signal to the driving transistor to compensate the threshold voltage of the driving transistor to the second node; continuously providing, by the second signal module, a first voltage signal to the first end of the second memory module;

S230: in the second stage, providing, by the second signal module, a second voltage signal to the first end of the second memory module to change the voltage signal of the second node; wherein the second voltage signal is greater than the first voltage signal;

S240: in a light-emitting stage, controlling, by the light-emitting control module, the driving current generated by the driving transistor to flow into the light-emitting element to drive the light-emitting element to emit light.

In the illustrated embodiment, with the arrangement of the second signal module, the electrical potential of the second node is raised, and the gate-drain voltage is decreased correspondingly from the basis of the original voltage, which results in the increase of the data range of the pixel circuit. Thus, the gamma of 0-255 gray scale can be easily adjusted.

Figure 19:
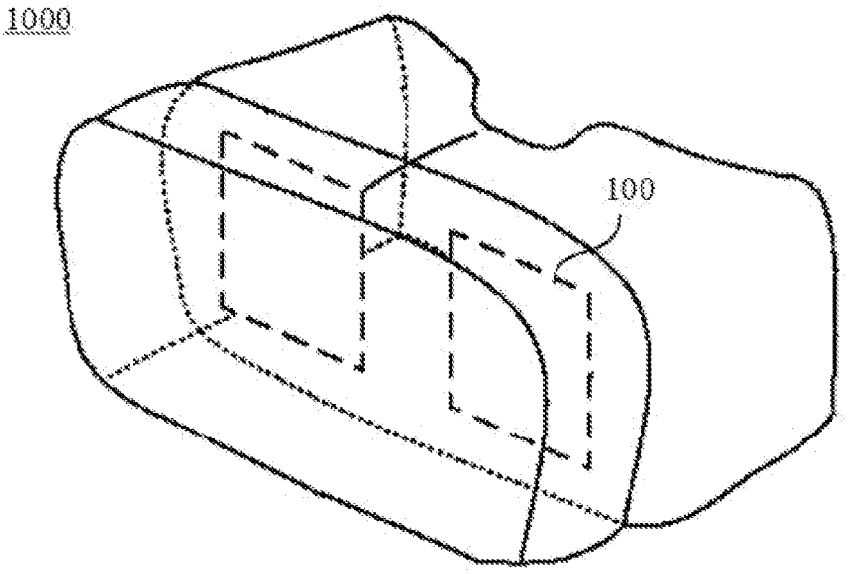
FIG. 19 is a structural schematic view of a display device according to an embodiment of the present disclosure.

Based on a same concept with the above display panel, the present disclosure further provides a display device. FIG. 19 is a structural schematic view of a display device 1000 according to an embodiment of the present disclosure. The display device 1000 includes the display panel 100. Display panel 100 is a display panels described above according to the present disclosure. In some embodiments, the display device 1000 may be an electronic display device such as an AR (Augmented Reality) display device, a VR (Virtual Reality) display device, a cellphone, a computer, a television, etc.

The above is a detailed description of the present disclosure in connection with the specific preferred embodiments, and the specific embodiments of the present disclosure are not limited to the description. Modifications and substitutions can be made without departing from the spirit and scope of the present disclosure.

What is claimed is:

1. A display panel comprising:

a substrate;

a plurality of sub-pixels located on one side of the substrate, wherein each sub-pixel comprises a pixel circuit and a light-emitting element, wherein the pixel circuit comprises a reset module, a data-writing module, a driving transistor, a light-emitting control module and a first memory module, wherein the data-writing module, a first end of the first memory module and a gate electrode of the driving transistor are electrically connected to a first node, wherein the reset module, a first electrode of the driving transistor, the light-emitting control module and a second end of the first memory module are electrically connected to a second node, and wherein the light-emitting element is electrically connected to the light-emitting control module; and at least one first signal module, wherein a first output end of the first signal module is electrically connected to the data-writing module, and a second output end of the first signal module is electrically connected to the reset module;

wherein the reset module is configured to provide a reset signal to an anode of the light-emitting element through the light-emitting control module in a reset stage;

wherein the first signal module is configured to provide a data voltage signal to the data-writing module in a data-writing stage to write the data voltage signal to the gate electrode of the driving transistor and the first end of the first memory module through the data-writing module, and the first signal module is further configured to provide a data current signal to the driving transistor in the data-writing stage to compensate a threshold voltage of the driving transistor to the second node;

wherein the light-emitting control module is configured to control a driving current generated by the driving transistor to flow into the light-emitting element to drive the light-emitting element to emit light, wherein the first signal module comprises a constant current source, an operational amplifier, a third gating unit and a fourth gating unit;

wherein a first end of the third gating unit is configured to receive a reset signal; a second end of the third gating unit, a second end of the fourth gating unit and the reset module are electrically connected to an inverse-phase input end of the operational amplifier; a first end of the fourth gating unit is electrically connected to the constant current source, a normal phase input end of the operational amplifier is configured to receive a reference voltage, and an output end of the operational amplifier is electrically connected to the data-writing module;

wherein the third gating unit is configured to provide a reset signal to the anode of the light-emitting element through the reset module and the light-emitting control module in the reset stage; and wherein the constant current source is configured to output the data voltage signal to the data-writing module through the fourth gating unit and the operational amplifier to write the data voltage signal to the gate electrode of the driving transistor and the first end of the first memory module through the data-writing module; and the constant current source is further configured to provide the data current signal to the driving transistor in the data-writing stage to compensate the threshold voltage of the driving transistor to the second node.

2. The display panel according to claim 1, wherein the substrate comprises a silicon substrate.

3. The display panel according to claim 1, wherein the display panel further comprises a second signal module for providing a jump signal, and the pixel circuit further comprises a second memory module, wherein the second memory module has a first end electrically connected to the second signal module, and a second end electrically connected to the second node;

wherein the data-writing stage comprises a first stage and a second stage; and wherein the second signal module is configured to provide a first voltage signal to the first end of the second memory module in the reset stage and the first stage, and provide a second voltage signal to the first end of the second memory module in the second stage to change a voltage signal of the second node, wherein the second voltage signal is greater than the first voltage signal.

4. The display panel according to claim 3, wherein first ends of second memory modules of each line of the sub-pixels are all electrically connected to a same second signal module.

5. The display panel according to claim 3, wherein the second signal module comprises:

a first gating unit configured to provide the first voltage signal to the first end of the second memory module in the reset stage and the first stage; and a second gating unit electrically connected to the first gating unit in parallel, and configured to provide the second voltage signal to the first end of the second memory module in the second stage.

6. The display panel according to claim 5, wherein the first gating unit comprises a first transistor having a first electrode, a second electrode and a gate electrode, and the second gating unit comprises a second transistor having a first electrode, a second electrode and a gate electrode;

wherein the second electrode of the first transistor and the second electrode of the second transistor are both electrically connected to the first end of the second memory module;

wherein the first electrode of the first transistor is configured to receive the first voltage signal, and the first electrode of the second transistor is configured to receive the second voltage signal;

wherein the gate electrode of the first transistor is configured to receive a first control signal, and turn on the first transistor according to the first control signal in the reset stage and the first stage; and wherein the gate electrode of the second transistor is configured to receive a second control signal, and turn on the second transistor according to the second control signal in the second stage.

7. The display panel according to claim 6, wherein the second signal module further comprises a first phase inverter having an input end and an output end; and wherein the input end of the first phase inverter and the gate electrode of the first transistor are configured to receive the first control signal, and the output end of the first phase inverter is electrically connected to the gate electrode of the second transistor.

8. The display panel according to claim 1, wherein data-writing modules of each column of the sub-pixels are all electrically connected to the first output end of a same first signal module, and reset modules of each column of the sub-pixels are all electrically connected to the second output end of a same first signal module.

9. The display panel according to claim 1, wherein the third gating unit comprises a third transistor having a first electrode, a second electrode and a gate electrode, and the fourth gating unit comprises a fourth transistor having a first electrode, a second electrode and a gate electrode;

wherein the second electrode of the third transistor and the second electrode of the fourth transistor are both electrically connected to the reset module;

wherein the first electrode of the third transistor is configured to receive the reset signal, and the first electrode of the fourth transistor is configured to receive data current signal output from the constant current source;

wherein the gate electrode of the third transistor is configured to receive a third control signal, and turning on the third transistor in the reset stage according to the third control signal; and wherein the gate electrode of the fourth transistor is configured to receive a fourth control signal, and turning on the fourth transistor in the data-writing stage according to the fourth control signal.

10. The display panel according to claim 9, wherein the first signal module further comprises a second phase inverter having an input end and an output end; and wherein the input end of the second phase inverter and the gate electrode of the third transistor are configured to receive the third control signal, and the output end of the second phase inverter is electrically connected to the gate electrode of the fourth transistor.

11. The display panel according to claim 3, wherein the reset module comprises a fifth transistor having a first electrode electrically connected to the second output end of the first signal module, a second electrode electrically connected to the second node, and a gate electrode electrically connected to a second scan signal end;

wherein the data-writing module comprises a sixth transistor having a first electrode electrically connected to the first output end of the first signal module, a second electrode electrically connected to the gate electrode of the driving transistor, and a gate electrode electrically to a first scan signal end;

wherein the light-emitting control module comprises a seventh transistor having a first electrode connected to the second node, a second electrode electrically connected to the anode of the light-emitting element, and a gate electrode electrically connected to a light-emitting control signal end;

wherein the first memory module comprises a first capacitor, and the second memory module comprises a second capacitor; and wherein a second electrode of the driving transistor is electrically connected to a first power source end, and a cathode of the light-emitting element is electrically connected to a second power source end.

12. The display panel according to claim 11, wherein the first voltage signal is a first power signal transmitted by the first power source end, or the second voltage signal is a second power signal transmitted by the second power source end.

13. The display panel according to claim 11, wherein the first capacitor is a MIN capacitor or a MOS capacitor; and the second capacitor is a MIN capacitor.

14. The display panel according to claim 1, wherein the data-writing module comprises a transmission gate having a N-type transistor and a P-type transistor, a first electrode of the N-type transistor and a first electrode of the P-type transistor are both electrically connected to the first output end of the first signal module, a second electrode of the N-type transistor and a second electrode of the P-type transistor are both electrically connected to the first node, a gate node of the N-type transistor is electrically connected to a first scan signal end, and a gate electrode of the P-type transistor is electrically connected to a third scan signal end; and wherein a first scan signal transmitted by the first scan signal end is opposite to a third scan signal transmitted by the third scan signal end at the same time.

15. A method for driving a display panel, the method comprises:

in a reset stage, providing, by a reset module, a reset signal to an anode of a light-emitting element through a light-emitting control module;

in a data-writing stage, providing, by a first signal module, a data voltage signal to a data-writing module to write the data voltage signal to a gate electrode of a driving transistor and a first end of a first memory module through the data-writing module; and providing, by the first signal module, a data current signal to the driving transistor to compensate a threshold voltage of the driving transistor to a second node; and in a light-emitting stage, controlling, by the light-emitting control module, a driving current generated by the driving transistor to flow into the light-emitting element to drive the light-emitting element to emit light;

wherein the data-writing module, a first end of the first memory module and a gate electrode of the driving transistor are electrically connected to a first node, wherein the reset module, a first electrode of the driving transistor, the light-emitting control module and a second end of the first memory module are electrically connected to the second node, and wherein the light-emitting element is electrically connected to the light-emitting control module;

wherein a first output end of the first signal module is electrically connected to the data-writing module, and a second output end of the first signal module is electrically connected to the reset module;

wherein the first signal module comprises a constant current source, an operational amplifier, a third gating unit and a fourth gating unit;

wherein a first end of the third gating unit is configured to receive a reset signal, a second end of the third gating unit, a second end of the fourth gating unit and the reset module are electrically connected to an inverse-phase input end of the operational amplifier, a first end of the fourth gating unit is electrically connected to the constant current source, a normal phase input end of the operational amplifier is configured to receive a reference voltage, and an output end of the operational amplifier is electrically connected to the data-writing module;

wherein the third gating unit is configured to provide a reset signal to the anode of the light-emitting element through the reset module and the light-emitting control module in the reset stage; and wherein the constant current source is configured to output the data voltage signal to the data-writing module through the fourth gating unit and the operational amplifier to write the data voltage signal to the gate electrode of the driving transistor and the first end of the first memory module through the data-writing module, and the constant current source is further configured to provide the data current signal to the driving transistor in the data-writing stage to compensate the threshold voltage of the driving transistor to the second node.

16. The method according to claim 15, wherein the display panel further comprises at least one second signal module for providing a jump signal, and a second memory module having a first end electrically connected to the second signal module, and a second end electrically connected to the second node, the method further comprising:

in the reset stage, providing, by the reset module, the reset signal to the anode of the light-emitting element through the light-emitting control module, and providing, by the second signal module, a first voltage signal to the first end of the second memory module;

in a first stage of the data-writing stage, providing, by the first signal module, the data voltage signal to the data-writing module to write the data voltage signal to the gate electrode of the driving transistor and the first end of the first memory module through the data-writing module, and providing, by the first signal module, the data current signal to the driving transistor to compensate the threshold voltage of the driving transistor to the second node; and continuingly providing, by the second signal module, the first voltage signal to the first end of the second memory module; and in a second stage of the data-writing stage, providing, by the second signal module, a second voltage signal to the first end of the second memory module to change a voltage signal of the second node, wherein the second voltage signal is greater than the first voltage signal.

17. The method according to claim 15, wherein the display panel comprises a silicon substrate.

18. A display device comprising a display panel according to claim 1.

19. The display device according to claim 18, wherein the display panel comprises a silicon substrate.

20. A display panel comprising:

a substrate;

a plurality of sub-pixels located on one side of the substrate, wherein each sub-pixel comprises a pixel circuit and a light-emitting element, wherein the pixel circuit comprises a reset module, a data-writing module, a driving transistor, a light-emitting control module and a first memory module, wherein the data-writing module, a first end of the first memory module and a gate electrode of the driving transistor are electrically connected to a first node, wherein the reset module, a first electrode of the driving transistor, the light-emitting control module and a second end of the first memory module are electrically connected to a second node, and wherein the light-emitting element is electrically connected to the light-emitting control module; and at least one first signal module, wherein a first output end of the first signal module is electrically connected to the data-writing module, and a second output end of the first signal module is electrically connected to the reset module;

wherein the reset module is configured to provide a reset signal to an anode of the light-emitting element through the light-emitting control module in a reset stage;

wherein the first signal module is configured to provide a data voltage signal to the data-writing module in a data-writing stage to write the data voltage signal to the gate electrode of the driving transistor and the first end of the first memory module through the data-writing module, and the first signal module is further configured to provide a data current signal to the driving transistor in the data-writing stage to compensate a threshold voltage of the driving transistor to the second node;

wherein the light-emitting control module is configured to control a driving current generated by the driving transistor to flow into the light-emitting element to drive the light-emitting element to emit light, wherein the display panel further comprises a second signal module for providing a jump signal, and the pixel circuit further comprises a second memory module, wherein the second memory module has a first end electrically connected to the second signal module, and a second end electrically connected to the second node;

wherein the data-writing stage comprises a first stage and a second stage; and wherein the second signal module is configured to provide a first voltage signal to the first end of the second memory module in the reset stage and the first stage, and provide a second voltage signal to the first end of the second memory module in the second stage to change a voltage signal of the second node, and wherein the second voltage signal is greater than the first voltage signal.

* * * * *